US011351808B2

(12) United States Patent
Tanaka et al.

(10) Patent No.: US 11,351,808 B2
(45) Date of Patent: Jun. 7, 2022

(54) RECORDING MEDIUM POST-PROCESSING DEVICE

(71) Applicant: FUJIFILM Business Innovation Corp., Tokyo (JP)

(72) Inventors: Hidenori Tanaka, Kanagawa (JP); Hiroki Oka, Kanagawa (JP); Ayumi Ikegaya, Kanagawa (JP); Keiichi Asajima, Kanagawa (JP); Yuzo Fujita, Kanagawa (JP); Ryusuke Yamanashi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 167 days.

(21) Appl. No.: 16/574,050

(22) Filed: Sep. 17, 2019

(65) Prior Publication Data

US 2020/0094605 A1 Mar. 26, 2020

(30) Foreign Application Priority Data

Sep. 25, 2018 (JP) ..... JP2018-179520

(51) Int. Cl.

| | |
|---|---|
| ***B42C 19/02*** | (2006.01) |
| ***B42C 1/12*** | (2006.01) |
| ***B65H 35/00*** | (2006.01) |
| ***B65H 37/04*** | (2006.01) |

(52) U.S. Cl.

CPC ..... *B42C 19/02* (2013.01); *B42C 1/12* (2013.01); *B65H 35/008* (2013.01); *B65H 37/04* (2013.01)

(58) Field of Classification Search

CPC ..... B42P 2241/08; B65H 2301/51616

See application file for complete search history.

(56) References Cited

U.S. PATENT DOCUMENTS

| | | | | |
|---|---|---|---|---|
| 5,639,077 | A * | 6/1997 | Hirano | B42C 1/125 270/58.12 |
| 9,238,567 | B2 * | 1/2016 | Jones | B41F 13/60 |
| 2005/0152725 | A1 * | 7/2005 | Mochizuki | B42C 1/12 399/410 |
| 2015/0063953 | A1 * | 3/2015 | Taguchi | B42C 19/02 412/37 |
| 2015/0117983 | A1 * | 4/2015 | Kubota | B65H 5/08 412/35 |
| 2016/0360053 | A1 * | 12/2016 | Suzuki | B41L 43/12 |
| 2018/0178576 | A1 * | 6/2018 | Iida | G06F 3/121 |
| 2018/0339485 | A1 * | 11/2018 | Takahashi | B42C 1/12 |

FOREIGN PATENT DOCUMENTS

| | | | |
|---|---|---|---|
| JP | 2011201670 | | 10/2011 |
| JP | 2011201670 | A * | 10/2011 |

* cited by examiner

*Primary Examiner* — Jennifer Bahls
(74) *Attorney, Agent, or Firm* — JCIPRNET

(57) ABSTRACT

A recording medium post-processing device includes a binding unit and a hole forming unit. The binding unit performs a binding process on a recording medium bundle. The hole forming unit performs a hole forming process in a region of recording media that constitute the recording medium bundle including a part of a binding region in which the binding process is performed.

14 Claims, 15 Drawing Sheets

FIG. 12

| NUMBER OF SHEETS TO BE BOUND | NUMBER OF HOLES | | | |
|---|---|---|---|---|
| | 2 LOCATIONS | 3 LOCATIONS | 4 LOCATIONS | 26 LOCATIONS |
| $N \leq 10$ | (9A) + (9B) | (9A) + (9B) | (10A) + (10B) | (11A) + (11B) |
| $10 < N \leq 20$ | (9A) + (9B) + (9C) | (9A) + (9B) + (9C) | (10A) + (10B) + (10C) + (10D) | (11A) + (11B) + (11C) + (11D) |
| $N > 20$ | (9A) + (9B) + (9C) + (9D) + (9E) | (9A) + (9B) + (9C) + (9D) + (9E) | (10A) + (10B) + (10C) + (10D) + (10E) + (10F) | (11A) + (11B) + (11C) + (11D) + (11E) + (11F) |

RECORDING MEDIUM POST-PROCESSING DEVICE

CROSS-REFERENCE TO RELATED APPLICATIONS

This application is based on and claims priority under 35 USC 119 from Japanese Patent Application No. 2018-179520 filed Sep. 25, 2018.

BACKGROUND

(i) Technical Field

The present disclosure relates to a recording medium post-processing device.

(ii) Related Art

Japanese Unexamined Patent Application Publication No. 2011-201670 discloses that a punch mechanism portion performs a hole forming process on one or more sheets of paper that constitute pages excluding the first page and the last page at one or more positions corresponding to binding positions, and that a binding mechanism portion performs a binding process in regions in which the hole forming process has been performed by the punch mechanism portion.

SUMMARY

A recording medium post-processing device occasionally performs a binding process on a recording medium bundle.

A recording medium is occasionally removed from the recording medium bundle which has been subjected to the binding process. In some cases, a portion of the recording medium bundle at which the binding process has been performed is torn when removing a recording medium from the recording medium bundle.

Aspects of non-limiting embodiments of the present disclosure relate to suppressing tear of a portion of a recording medium bundle at which a binding process has been performed due to removal of a recording medium from the recording medium bundle which has been subjected to the binding process compared to a case where a region in which the binding process is performed and a region in which a hole forming process is performed do not overlap each other in a recording medium bundle.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a recording medium post-processing device including: a binding unit that performs a binding process on a recording medium bundle; and a hole forming unit that performs a hole forming process in a region of recording media that constitute the recording medium bundle including a part of a binding region in which the binding process is performed.

BRIEF DESCRIPTION OF THE DRAWINGS

Exemplary embodiments of the present disclosure will be described in detail based on the following figures, wherein:

FIG. 12 illustrates the relationship among the number of sheets of paper that constitute a paper bundle B to be subjected to a binding process, the number of locations of the paper bundle at which a hole is to be formed, and locations of the paper bundle at which a binding process is to be performed in the filing mode;

DETAILED DESCRIPTION

First Exemplary Embodiment

An exemplary embodiment of the present disclosure will be described in detail below with reference to the accompanying drawings.

Figure 1:
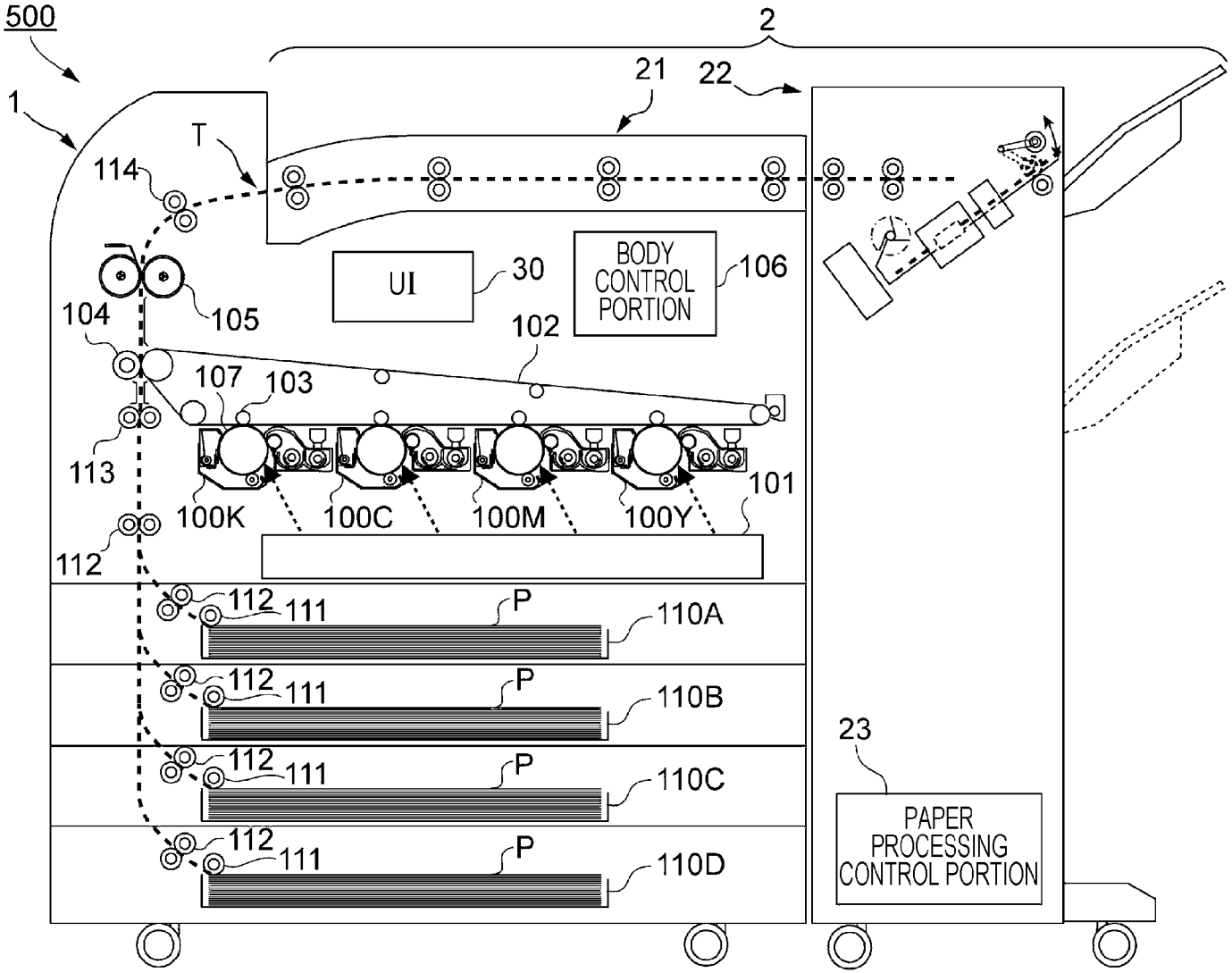
FIG. 1 illustrates the configuration of an image forming system.

FIG. 1 illustrates the configuration of an image forming system 500 to which an exemplary embodiment is applied.

The image forming system 500 illustrates in FIG. 1 includes an image forming apparatus 1 that forms a color image on paper P that serves as an example of a recording medium, and a post-processing device 2 that performs post-processing such as a binding process and a hole forming process on the paper P on which an image has been formed by the image forming apparatus 1.

Examples of the image forming apparatus 1 include a printer and a copier.

The image forming apparatus 1 includes four image forming units 100Y, 100M, 100C, and 100K (also referred to collectively as "image forming units 100") that form an image on the basis of image data for various colors.

The image forming apparatus 1 also includes a laser exposure device 101 that exposes a photoconductor drum 107 provided in each of the image forming units 100 to light. The image forming apparatus 1 further includes an intermediate transfer belt 102 to which toner images in various colors formed by the image forming units 100 are transferred in a multiplexed manner.

The image forming apparatus 1 also includes a first transfer roller 103 that transfers the toner image in each color which has been formed by each of the image forming units 100 to the intermediate transfer belt 102 through a first transfer, a second transfer roller 104 that transfers the toner images in various colors which have been transferred onto the intermediate transfer belt 102 to the paper P through a second transfer, and a fixing device 105 that fixes the toner images in various colors which have been transferred through the second transfer onto the paper P. The image forming apparatus 1 also includes a body control portion 106 constituted by a central processing unit (CPU) controlled by a program to control operation of the image forming apparatus 1.

The image forming apparatus 1 also includes a user interface (UI) 30 that displays information to a user. The UI 30 is constituted by a display panel or the like. The UI 30 also receives an operation from the user.

In each of the image forming units 100 of the image forming apparatus 1, a toner image in each color is formed through a charging process for the photoconductor drum 107, an electrostatic latent image forming process for the photoconductor drum 107 using scanning light from the laser exposure device 101, a developing process for toners in various colors in the formed electrostatic latent image, etc.

The toner images in various colors which are formed by the image forming units 100 are transferred onto the intermediate transfer belt 102 by the first transfer rollers 103 through the first transfer. Then, the toner images in various colors are transported to the position of installation of the second transfer roller 104 along with movement of the intermediate transfer belt 102.

In the image forming apparatus 1, meanwhile, a plurality of sheets of the paper P of different sizes and different paper types are accommodated in paper storing portions 110A to 110D.

Then, when an image is to be formed on the paper P, the paper P is picked up from the paper storing portion 110A by a pickup roller 111, for example, and transported to the position of a resist roller 113, one sheet at a time, by a transport roller 112.

Then, the paper P is supplied from the resist roller 113 in accordance with the timing when the toner images in various colors on the intermediate transfer belt 102 are transported to the position at which the second transfer roller 104 is disposed.

Consequently, the toner images in various colors are collectively transferred onto the paper P through the second transfer by the effect of a transfer electric field formed by the second transfer roller 104.

After that, the paper P to which the toner images in various colors have been transferred through the second transfer is separated from the intermediate transfer belt 102, and transported to the fixing device 105. The fixing device 105 fixes the toner images in various colors onto the paper P through a fixing process which uses heat and a pressure, thereby forming an image.

Then, the paper P on which an image has been formed is ejected from a paper ejection portion T of the image forming apparatus 1 by a transport roller 114, and supplied to the post-processing device 2.

The post-processing device 2, which is an example of a recording medium post-processing device, is disposed downstream of the paper ejection portion T of the image forming apparatus 1, and performs a binding process and a hole forming process on the paper P on which an image has been formed.

[Configuration of Post-Processing Device]

Figure 2:
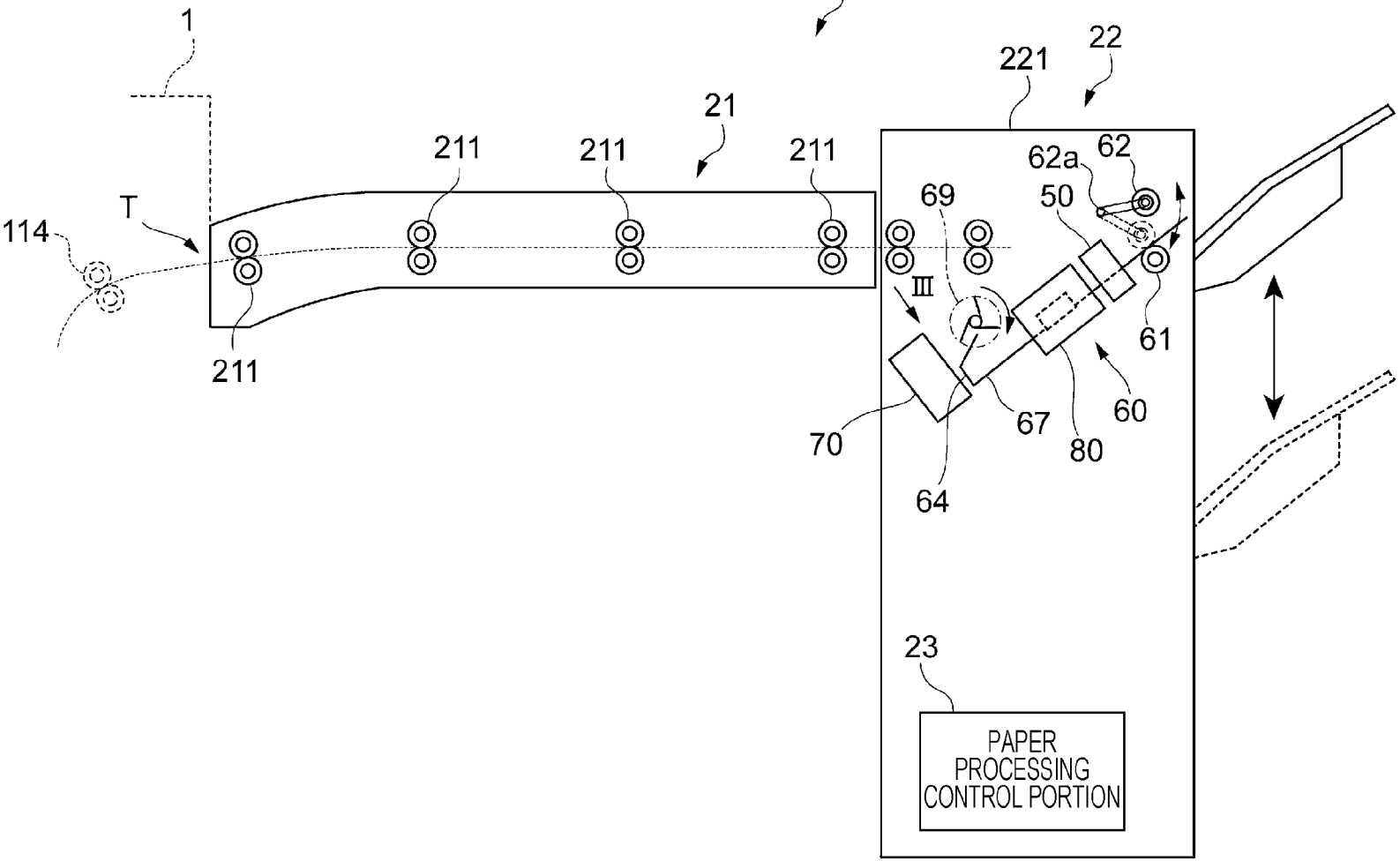
FIG. 2 illustrates the configuration of a post-processing device.

Next, the configuration of the post-processing device 2 will be described. FIG. 2 illustrates the configuration of the post-processing device 2.

The post-processing device 2 includes a transport unit 21 connected to the paper ejection portion T of the image forming apparatus 1, and a finisher unit 22 that performs a prescribed process on the paper P which is transported by the transport unit 21.

The post-processing device 2 also includes a paper processing control portion 23 constituted by a central processing unit (CPU) controlled by a program to control various mechanism portions of the post-processing device 2. The paper processing control portion 23 is connected to the body control portion 106 (see FIG. 1) through a signal line (not illustrated) to mutually transmit and receive a control signal etc.

The transport unit 21 of the post-processing device 2 includes a plurality of transport rollers 211 that transport the paper P, on which an image has been formed by the image forming apparatus 1, toward the finisher unit 22. The transport rollers 211 are considered as a transport unit that transports the paper P.

The finisher unit 22 includes a finisher unit body 221, a paper stacking portion 60 that allows a necessary number of sheets of the paper P to be stacked thereon to generate a paper bundle, and a non-needle-binding unit 50 that performs a binding process at an end portion of the paper bundle, which is generated by the paper stacking portion 60, without using a staple. The finisher unit 22 also includes a needle-binding unit 70 that performs a binding process at an end portion of the paper bundle, which is generated by the paper stacking portion 60, using a staple, and a hole forming unit 80 that performs a hole forming process at an end portion of the paper bundle which is generated by the paper stacking portion 60.

The paper stacking portion 60 is considered as a stacking unit on which sheets of the paper P transported by the transport rollers 211 are stacked. The non-needle-binding unit 50 and the needle-binding unit 70 are each considered as a binding unit that performs a binding process on a paper bundle. The hole forming unit 80 is considered as a hole forming unit that performs a hole forming process on a paper bundle.

The finisher unit 22 also includes a transport roller 61 that is provided rotatably and used to transport the paper bundle which is generated by the paper stacking portion 60. The finisher unit 22 further includes a movable roller 62 that is provided so as to be swingable about a rotary shaft 62*a* as the center of movement and movable to a position at which the movable roller 62 is retracted from the transport roller 61 and a position at which the movable roller 62 is in press contact with the transport roller 61. The finisher unit 22 also includes a stacker 80 on which the paper bundle, which is transported by the transport roller 61 and the movable roller 62, is stacked. The stacker 80 is moved up and down in accordance with the amount of the paper bundle to be held.

When processing is performed by the post-processing device 2, first, the paper P is transported from the image forming apparatus 1 to the transport unit 21 of the post-processing device 2. The paper P which is transported to the transport unit 21 is fed to the finisher unit 22 by the transport rollers 211.

The paper P which is fed to the finisher unit 22 is transported to the paper stacking portion 60. More particularly, the paper P is transported a location over the paper stacking portion 60, and thereafter falls down to the paper stacking portion 60. Then, the paper P is supported from below by a support plate 67 provided to the paper stacking portion 60. Further, the paper P is moved to slide on the support plate 67 by a paddle 69 provided to the support plate 67 to be inclined and rotated.

After that, the paper P abuts against an end guide 64 attached to an end portion of the support plate 67. Consequently, movement of the paper P is stopped in the present exemplary embodiment.

Subsequently, this operation is performed each time the paper P is transported from the upstream side, and a paper bundle with the respective rear end portions of sheets of the paper P aligned is generated. The paper bundle is considered as a recording medium bundle.

Then, when a prescribed number of sheets of the paper P are stacked on the support plate 67 and a paper bundle is generated on the support plate 67, post-processing on the paper bundle is executed using the non-needle-binding unit 50, the needle-binding unit 70, the hole forming unit 80, etc.

When the post-processing on the paper bundle is ended, the movable roller 62 is advanced toward the transport roller 62, and the paper bundle is clamped between the movable roller 62 and the transport roller 61. After that, the transport roller 61 and the movable roller 62 are rotationally driven so that the paper bundle which has been subjected to a binding process is transported to the stacker 80.

Figure 3:
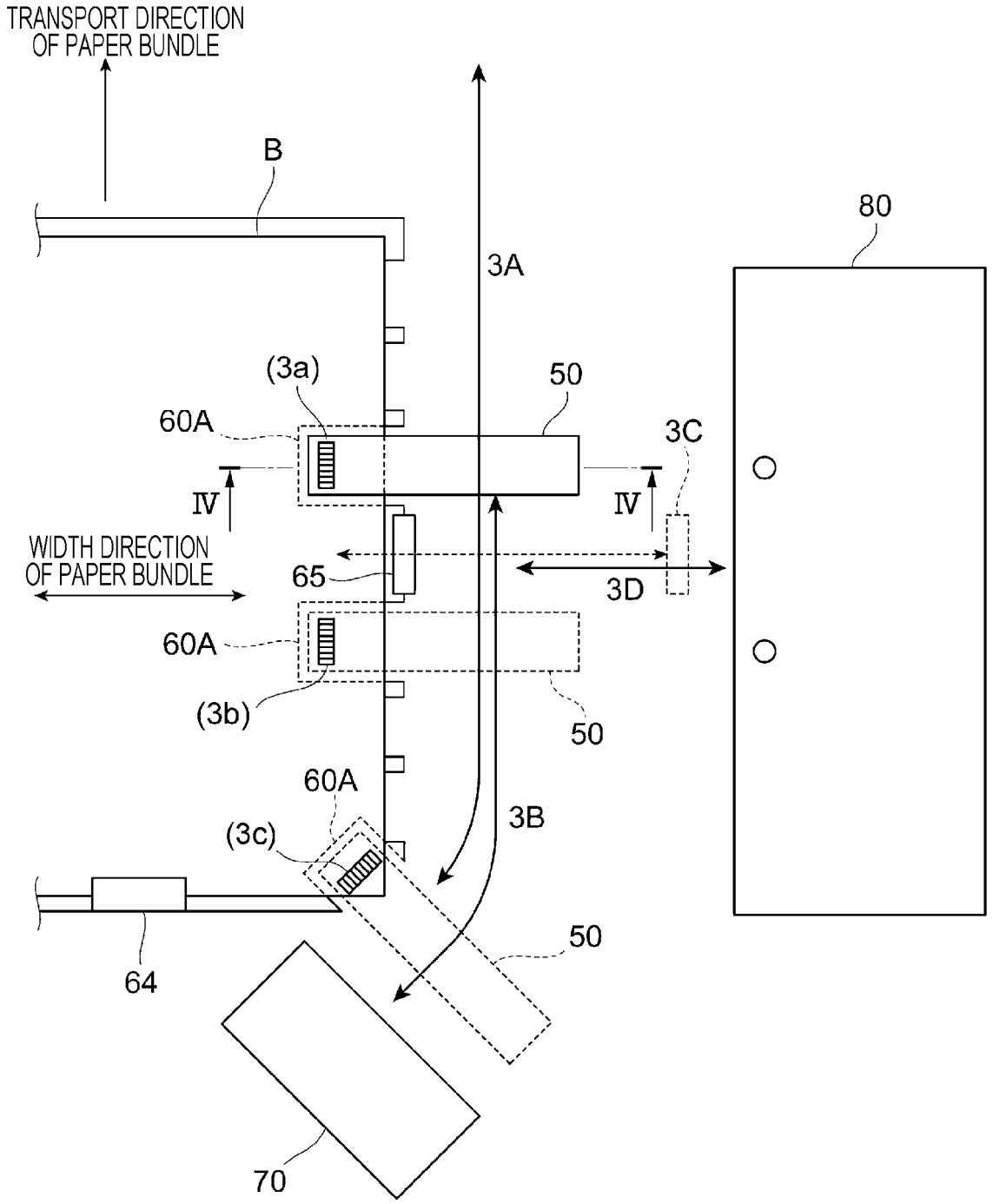
FIG. 3 illustrates a non-needle-binding unit etc. as seen in the direction of the arrow III in FIG. 2.

FIG. 3 illustrates the non-needle-binding unit 50 etc. as seen in the direction of the arrow III in FIG. 2.

The paper stacking portion 60 includes alignment members 65. The alignment members 65 are provided at both end portions of the paper stacking portion 60 in the width direction, although partially not illustrated. The alignment members 65 are pushed against the lateral sides of sheets of the paper P each time a sheet of the paper P arrives at the paper stacking portion 60 to align the end portions of the sheets of the paper P. In addition, the alignment members 65 are moved in the width direction of the paper bundle B to move the paper bundle B in the width direction of the paper bundle B. The alignment members 65 are considered as an alignment unit that aligns sheets of the paper P by clamping the sheets of the paper P at one end portion and the other end portion thereof in the width direction.

As indicated by the arrow 3A in FIG. 3, the non-needle-binding unit 50 is provided so as to be movable in the transport direction of the paper bundle B. The non-needle-binding unit 50 performs a binding process at a plurality of locations of the paper bundle B in the transport direction of the paper bundle B, such as in a (3*a*) region and a (3*b*) region, for example, when the non-needle-binding unit 50 is moved to such positions. The non-needle-binding unit 50 also performs a binding process at a corner portion of the paper bundle B, which is indicated by a (3*c*) region of the paper bundle B, when the non-needle-binding unit 50 is moved to the vicinity of the corner portion of the paper bundle B.

The (3*c*) region is a region that is different from regions of the paper bundle B in the transport direction of the paper bundle B, including the (3*a*) region and the (3*b*) region.

The non-needle-binding unit 50 is moved linearly between the position at which the non-needle-binding unit 50 performs binding in the (3*a*) region of the paper bundle B and the position at which the non-needle-binding unit 50 performs binding in the (3*b*) region. Meanwhile, the non-needle-binding unit 50 is moved while being rotated by 45°, for example, between the position at which the non-needle-binding unit 50 performs binding in the (3*b*) region of the paper bundle B and the position at which the non-needle-binding unit 50 performs binding in the (3*c*) region.

The paper stacking portion 60 is provided with a plurality of notches 60A. This suppresses interference between the non-needle-binding unit 50 and the paper stacking portion 60.

As indicated by the arrow 3B in FIG. 3, in addition, the needle-binding unit 70 is provided so as to be movable in the transport direction of the paper bundle B. The needle-binding unit 70 performs a binding process at a plurality of locations of the paper bundle B in the transport direction of the paper bundle B, such as in a part of the (3*a*) region and a part of the (3*b*) region, for example. The non-needle-binding unit 50 also performs a binding process at a corner portion of the paper bundle B, which is indicated by the (3*c*) region of the paper bundle B, when the non-needle-binding unit 50 is moved to the vicinity of the corner portion of the paper bundle B.

As indicated by the arrow 3D in FIG. 3, in addition, the hole forming unit 80 is provided so as to be movable in the width direction of the paper bundle B. The hole forming unit 80 performs a hole forming process at a plurality of locations in the transport direction of the paper bundle B. In the illustrated example, the hole forming unit 80 is not limited to performing a hole forming process at two locations in the transport direction of the paper bundle B, and may perform a hole forming process at three locations or more in the transport direction of the paper bundle B. In addition, the hole forming unit 80 may be able to perform a hole forming process in a part of a region of the paper bundle B including the (3*c*) region.

The order of the binding process and the hole forming process for a case where the binding process and the hole forming process are performed on the paper bundle B will be described.

When the paper bundle B is stacked on the paper stacking portion 60, first, the binding process by the non-needle-binding unit 50 or the needle-binding unit 70 is performed on the paper bundle B. In the case where the binding process by the non-needle-binding unit 50 is performed on the paper bundle B, the binding process by the needle-binding unit 70 is not performed on the paper bundle B. When the binding process by the non-needle-binding unit 50 is performed on the paper bundle B, the needle-binding unit 70 and the hole forming unit 80 are moved to positions at which the needle-binding unit 70 and the hole forming unit 80 are retracted from the paper bundle B. In the case where the binding process by the needle-binding unit 70 is performed on the paper bundle B, meanwhile, the binding process by the non-needle-binding unit 50 is not performed on the paper bundle B. When the binding process by the needle-binding unit 70 is performed on the paper bundle B, the non-needle-binding unit 50 and the hole forming unit 80 are moved to positions at which the non-needle-binding unit 50 and the hole forming unit 80 are retracted from the paper bundle B.

When the binding process is performed on the paper bundle B, the hole forming process by the hole forming unit 80 is next performed on the paper bundle. When the hole forming process is performed on the paper bundle B, the non-needle-binding unit 50 and the needle-binding unit 70 are moved to positions at which the non-needle-binding unit 50 and the needle-binding unit 70 are retracted from the paper bundle B.

In this manner, the binding process and the hole forming process are performed on the paper bundle B without causing interference among the non-needle-binding unit 50, the needle-binding unit 70, and the hole forming unit 80.

In the present exemplary embodiment, when any of the non-needle-binding unit 50, the needle-binding unit 70, and the hole forming unit 80 is moved, the alignment member 65 is moved to a position indicated by symbol 3C in FIG. 3.

[Configuration of Non-Needle-Binding Unit]

Next, the configuration of the non-needle-binding unit 50 will be described.

Figure 4A:
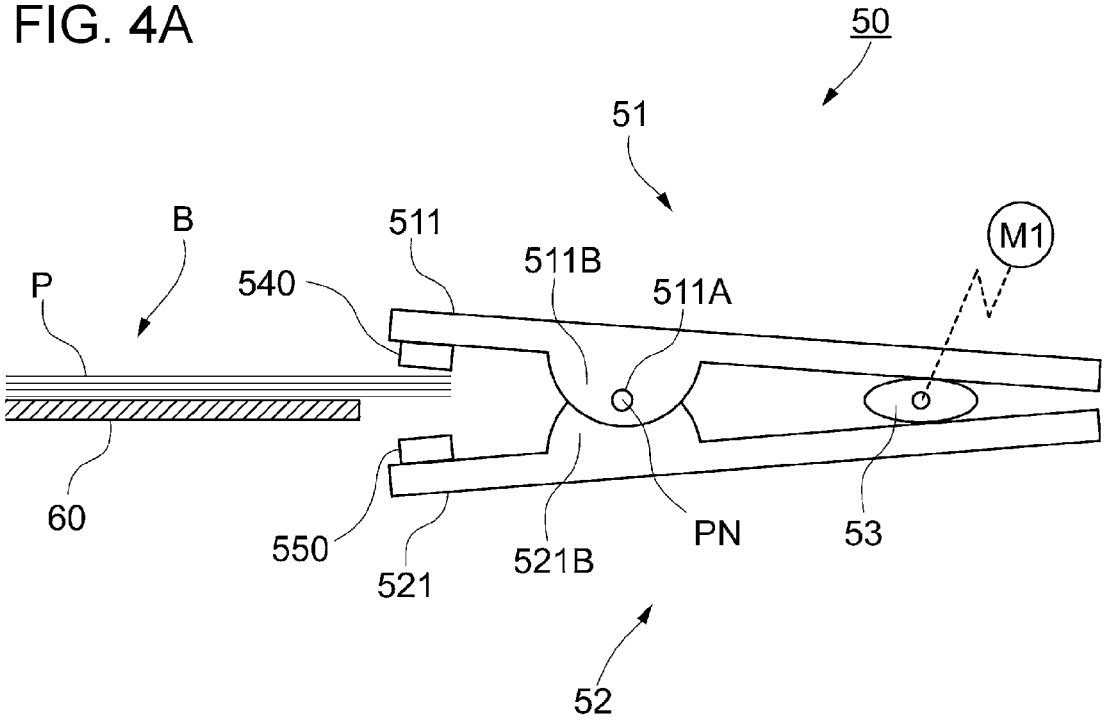
FIGS. 4A and 4B are each a sectional view taken along the line IV-IV in FIG. 3.
Figure 4B:
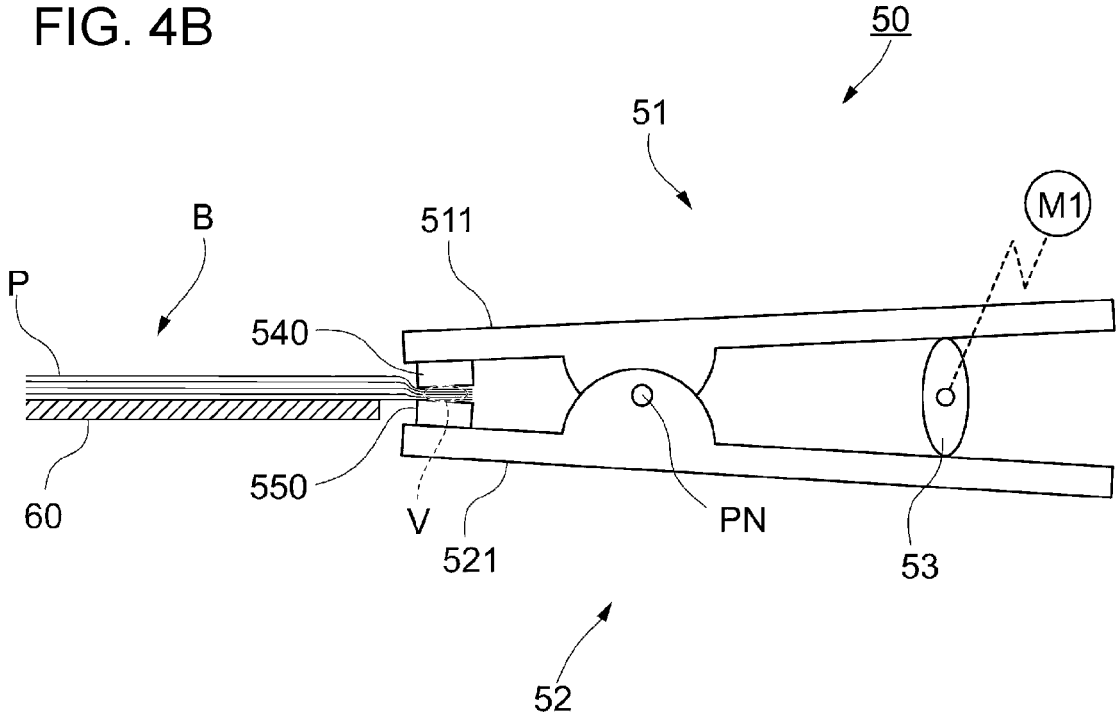

FIGS. 4A and 4B are each a sectional view taken along the line IV-IV in FIG. 3.

As illustrated in FIG. 4A, the non-needle-binding unit 50 includes a first drive portion 51 that extends in the right-left direction in the drawing, a second drive portion 52 that also extends in the right-left direction in the drawing, an oval cam 53 disposed between the first drive portion 51 and the second drive portion 52, and a cam motor Ml that drives the cam 53.

The first drive portion 51 includes a drive piece 511. The drive piece 511 is formed in a plate shape, and has one end portion on the side of the paper bundle B and the other end portion on the opposite side from the one end portion.

In the present exemplary embodiment, an upper tooth 540 is attached to the one end portion of the drive piece 511. The upper tooth 540 is advanced from the side of one surface of the paper bundle B toward the paper bundle B to press the paper bundle B. In addition, the drive piece 511 includes a projecting portion 511B that projects toward the second drive portion 52, and the projecting portion 511B is formed with a through hole 511A.

As illustrated in FIG. 4A, the second drive portion 52 includes a drive piece 521.

The drive piece 521 is formed in a plate shape, and has one end portion on the side of the paper bundle B and the other end portion on the opposite side from the one end portion. In the present exemplary embodiment, a lower tooth 550 is attached to the one end portion of the drive piece 521. The lower tooth 550 is advanced toward the other surface of the paper bundle B to press the paper bundle B.

In addition, the drive piece 521 includes a projecting portion 521B that projects toward the first drive portion 51, and the projecting portion 521B is formed with a through hole (not illustrated).

In the present exemplary embodiment, in addition, a pin PN passes through the through hole 511A which is provided in the first drive portion 51 and the through hole which is provided in the second drive portion 52. In the present exemplary embodiment, the drive piece 511 and the drive piece 521 are swung about the pin PN.

In the present exemplary embodiment, further, the upper tooth 540 and the lower tooth 550 are provided on the side of the paper bundle B with respect to the pin PN, and the cam 53 is provided on the opposite side of the pin PN from the side on which the paper bundle B is provided.

In the present exemplary embodiment, when the cam 53 is rotated by the cam motor Ml, as illustrated in FIG. 4B, the upper tooth 540 and the lower tooth 550 are moved so as to approach each other, and the upper tooth 540 and the lower tooth 550 clamp the paper bundle B to apply a pressure to the paper bundle B. Consequently, fibers of the sheets of the paper P which constitute the paper bundle B are tangled with each other, and adjacent sheets of the paper P are joined to each other to form a bound portion V at which a plurality of sheets of the paper P are bound. The specific configuration of the non-needle-binding unit 50, in particular a mechanism for clamping the paper bundle B by causing the upper tooth 540 and the lower tooth 550 to approach each other, is not limited to the configuration described with reference to FIGS. 4A and 4B, and a variety of configurations that enable the upper tooth 540 an the lower tooth 550 to clamp and pressurize the paper bundle B may be adopted.

[Hardware Configuration of Paper Processing Control Portion]

Figure 5:
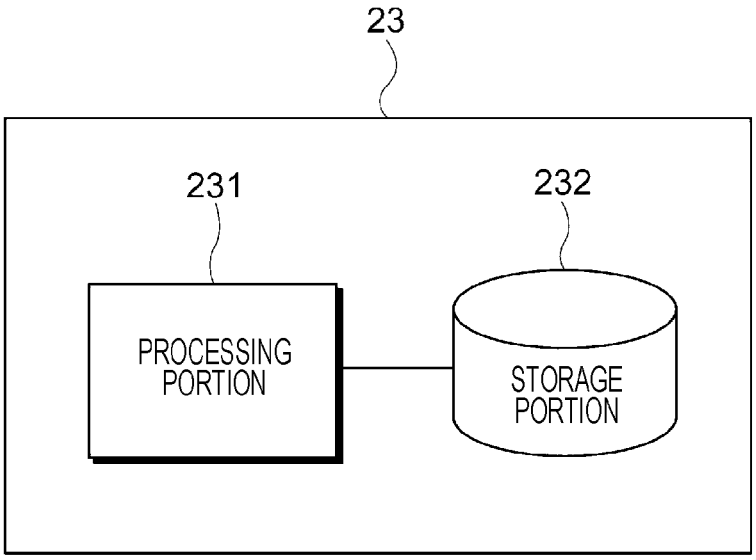
FIG. 5 illustrates the hardware configuration of a paper processing control portion.

FIG. 5 illustrates the hardware configuration of the paper processing control portion 23.

As illustrated in FIG. 5, the paper processing control portion 23 includes a processing portion 231 that executes a process program, and a storage portion 232 that stores various programs, various tables, parameters, etc. Examples of the processing portion 231 include a central processing unit (CPU). Examples of the storage portion 232 include a read only memory (ROM), a random access memory (RAM), and a hard disk drive (HDD).

The processing portion 231 performs various types of control and computation processing by executing a program stored in the storage portion 232. Consequently, the binding process by the non-needle-binding unit 50, the binding process by the needle-binding unit 70, and the hole forming process by the hole forming unit 80 are achieved.

[Relationship Between Binding Region and Hole Forming Region]

Next, the relationship between a binding region and a hole forming region will be described. The binding region is a region of the paper bundle B in which the binding process is performed. Meanwhile, the hole forming region is a region of the paper bundle B in which a hole is formed by the hole forming unit 80.

Figure 6A:
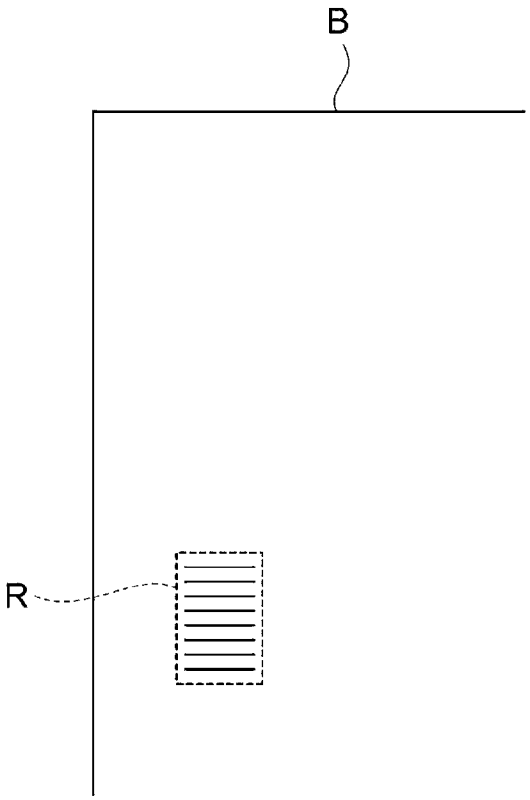
FIG. 6A illustrates a paper bundle that has been subjected to a binding process, and FIGS. 6B and 6C each illustrate a paper bundle that has been subjected to a binding process and a hole forming process.
Figure 6B:
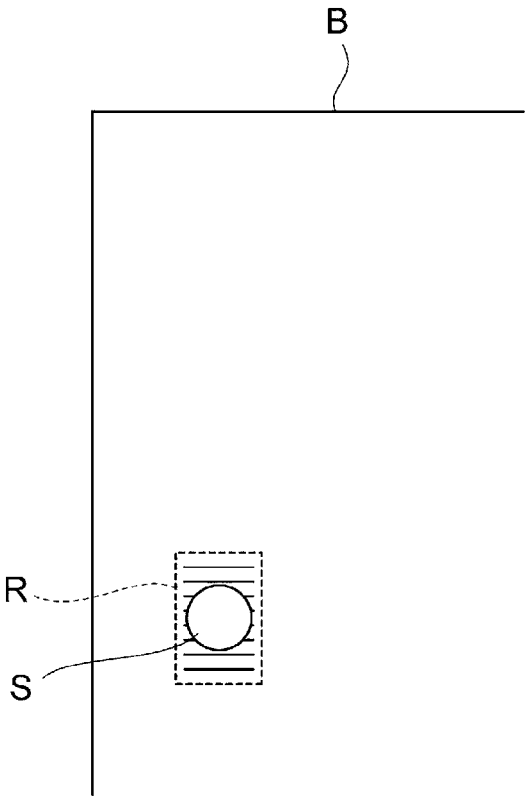
Figure 6C:
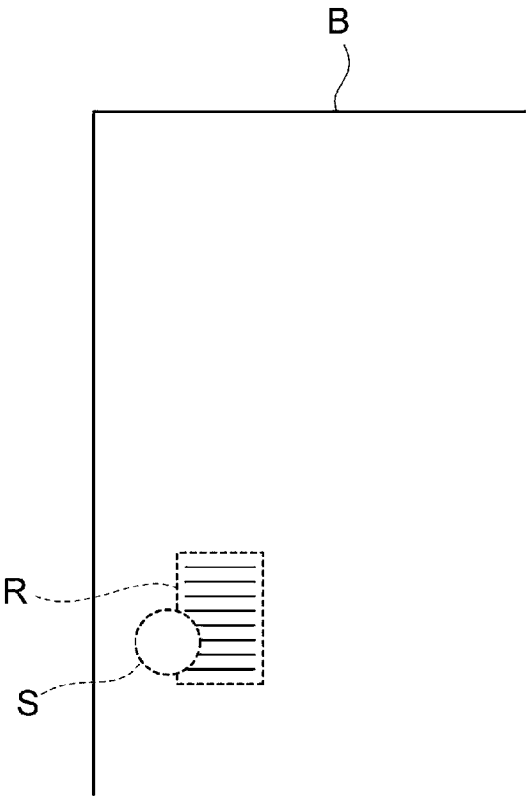

FIG. 6A illustrates the paper bundle B which has been subjected to the binding process. FIGS. 6B and 6C each illustrate the paper bundle B which has been subjected to the binding process and the hole forming process.

When the non-needle-binding unit 50 performs the binding process on the paper bundle B, sheets of the paper P that constitute the paper bundle B are pressure-bonded to each other in a binding region R to bind the paper bundle B as illustrated in FIG. 6A.

A sheet of the paper P is occasionally removed from the paper bundle B which has been subjected to the binding process. In some cases, a portion of the paper bundle B at which the binding process has been performed is torn when removing a sheet of the paper P from the paper bundle B.

As discussed above, the non-needle-binding unit 50 according to the present exemplary embodiment binds the paper bundle B by pressure-bonding sheets of the paper P that constitute the paper bundle B to each other by press-fitting the upper tooth 540 (see FIGS. 4A and 4B) and the lower tooth 550 to be engaged with each other in the thickness direction of the paper bundle B. In the case where the number of sheets of the paper P that constitute the paper bundle B is small, for example, a press-fitting force of the upper tooth 540 and the lower tooth 550 is easily applied to each of the sheets of the paper P which constitute the paper bundle B, and a binding force for the paper bundle B at a portion of the paper bundle B at which the binding process has been performed tends to be enhanced. When it is attempted to remove a sheet of the paper P from the paper bundle B in this case, the binding force for the paper bundle B acts on the portion of the paper bundle B at which the binding process has been performed, and the portion at which the binding process has been performed may be torn.

Thus, in the present exemplary embodiment, as illustrated in FIG. 6B, the hole forming unit 80 performs a hole forming process in a region including a part of the binding region R. That is, in the present exemplary embodiment, the hole forming process is performed in a hole forming region S including a part of the binding region R in which sheets of the paper P that constitute the paper bundle are subjected to the binding process.

In this case, the binding force for the paper bundle B at a portion of the paper bundle B at which the binding process has been performed is reduced by an amount corresponding to a reduction in the region of the paper bundle B in which sheets of the paper P are pressure-bonded to each other by the binding process, compared to a case where the binding region R and the hole forming region S do not overlap each other.

The region of the paper bundle B in which the binding process has been performed (region corresponding to the binding region R) is considered as a bound portion formed in a part of a plurality of sheets of the paper P to bind the plurality of sheets of the paper P. Meanwhile, as illustrated in FIG. 6B, the bound portion overlaps a region in which a hole is formed in each of the plurality of sheets of the paper P (region corresponding to the hole forming region S).

In the following, the binding process and the hole forming process which are performed such that a part of the binding region R and the hole forming region S overlap each other will be referred to as "overlapping post-processing". In addition, the paper processing control portion 23 is considered as a first control unit that performs binding control such that a binding unit performs a binding process in the binding region R in the case where the overlapping post-processing is performed. Further, the paper processing control portion 23 is considered as a second control unit that performs hole forming control such that the hole forming unit 80 performs a hole forming process in the hole forming region S in the case where the overlapping post-processing is performed.

While FIG. 6B illustrates an example in which the binding region R embraces the hole forming region S, the configuration in which the hole forming process is performed in the hole forming region S which includes a part of the binding region R is not limited to the example illustrated in FIG. 6B.

For example, overlapping post-processing may be performed with a part of the hole forming region S included in the binding region R and with the other part of the hole forming region S not included in the binding region R as illustrated in FIG. 6C.

[Control Mode of Paper Processing Control Portion]

Next, control modes for the paper processing control portion 23 will be described. In the present exemplary embodiment, the paper processing control portion 23 controls post-processing in a control mode that matches the purpose of binding the paper bundle B using the non-needle-binding unit 50. The control modes for the paper processing control portion 23 include a normal mode and a temporary fastening mode.

In the normal mode, which is an example of a first mode, the overlapping post-processing is not performed in the case where the paper bundle B is bound. The normal mode is used in the case where it is not assumed that a sheet of the paper P is removed from the paper bundle B after the paper bundle B is bound, for example.

In the temporary fastening mode, which is an example of a second mode, the overlapping post-processing is performed in the case where the paper bundle B is bound. The temporary fastening mode is used in the case where it is assumed that a sheet of the paper P may be removed from the paper bundle B after the paper bundle B is bound, for example.

Figure 7A:
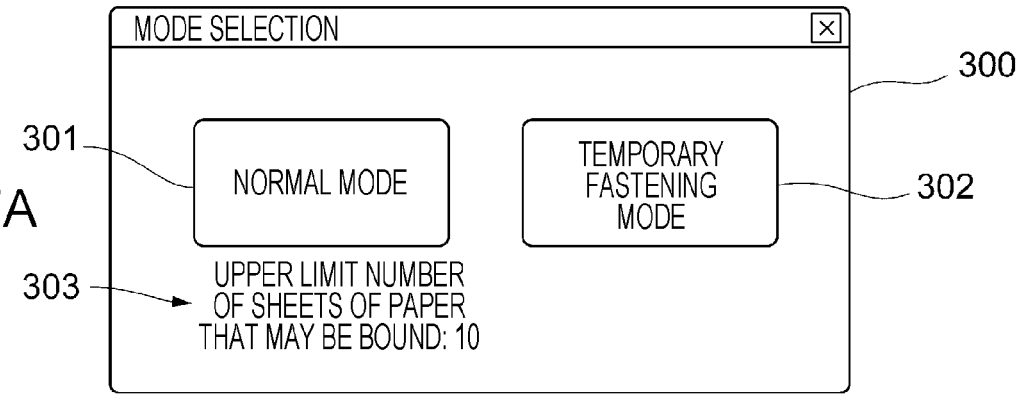
FIG. 7A illustrates a mode select screen, and FIGS. 7B to 7D each illustrate a normal mode setting screen.

FIG. 7A illustrates a mode select screen 300. The mode select screen 300 is used to select either of the normal mode and the temporary fastening mode as the control mode for the paper processing control portion 23. The mode select screen 300 is displayed on the UI 30 (see FIG. 1).

The mode select screen 300 displays a normal mode select portion 301 that is used to select the normal mode, and a temporary fastening mode select portion 302 that is used to select the temporary fastening mode. The mode select screen 300 also displays a normal binding sheet number indication portion 303.

The normal binding sheet number indication portion 30 displays the upper limit number of sheets of the paper P that may be bound in the normal mode. The upper limit number of sheets of the paper P that may be bound in the normal mode is the upper limit number of sheets of the paper P that is set in order to suppress separation of a sheet of the paper P from the paper bundle B in the case where it is not intended that the user removes a sheet of the paper P from the paper bundle B. In the illustrated example, the normal binding sheet number indication portion 303 indicates that the upper limit number of sheets of the paper P that may be bound in the normal mode is "10 sheets".

Figure 7B:
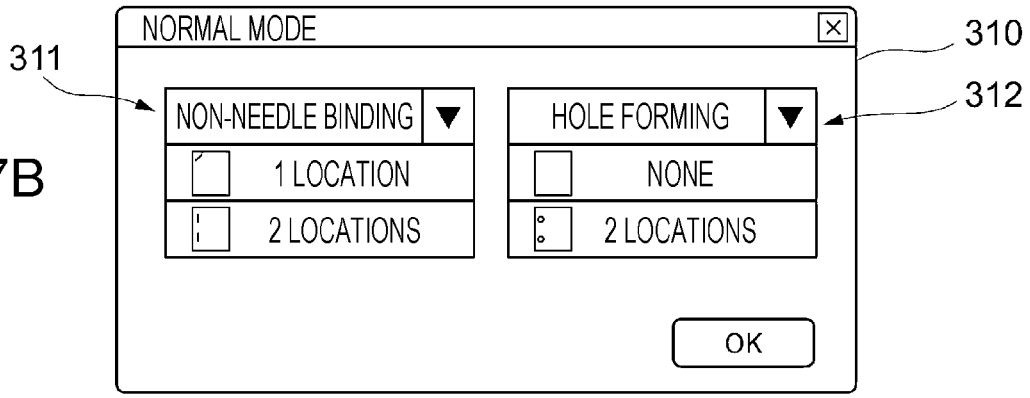

When the user selects the normal mode select portion 301, for example, a normal mode setting screen 310 is displayed on the UI 30 as illustrated in FIG. 7B. The normal mode setting screen 310 is used to set the content of the binding process in the normal mode.

The normal mode setting screen 310 displays a bound location setting portion 311 that is used to set the locations of the paper bundle B at which the binding process is to be performed, and a hole forming location setting portion 312 that is used to set the locations of the paper bundle B at which a hole is to be formed by the hole forming process.

In the bound location setting portion 311, either of "1 location" and "2 locations" is selectable as the number of locations of the paper bundle B at which the binding process is to be performed. The "1 location" indicated in the bound location setting portion 311 corresponds to the (3*c*) region in FIG. 3. The "2 locations" indicated in the bound location setting portion 311 correspond to the (3*a*) region and the (3*b*) region in FIG. 3.

In the hole forming location setting portion 312, either "none" and "2 locations" is selectable as the number of locations of the paper bundle B at which a hole is to be formed by the hole forming process. The "none" indicated in the hole forming location setting portion 312 means that the hole forming process is not performed on the paper bundle B. The "2 locations" indicated in the hole forming location setting portion 312 correspond to a region including a part of the (3*a*) region in FIG. 3 and a region including a part of the (3*b*) region in FIG. 3.

Figure 7C:
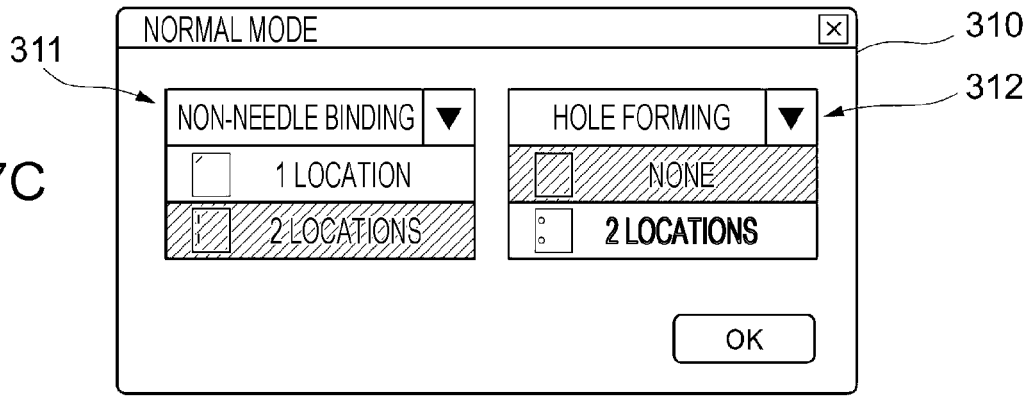

When the user selects the "2 locations" in the bound location setting portion 311, for example, the display color of the "2 locations" in the bound location setting portion 311 is changed as illustrated in FIG. 7C. At this time, in addition, the "none" is selected with the display color of the "none" in the hole forming location setting portion 312 changed. At this time, further, the "2 locations" in the hole forming location setting portion 312 is not selectable by the user.

Figure 7D:
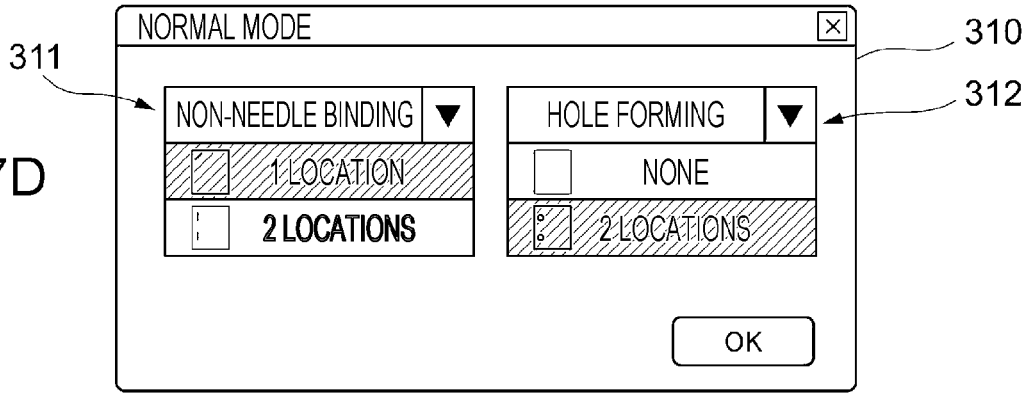

When the user selects the "2 locations" in the hole forming location setting portion 312, for example, in the case where the normal mode setting screen 310 in FIG. 7B is displayed on the UI 30, the display color of the "2 locations" in the hole forming location setting portion 312 is changed as illustrated in FIG. 7D. At this time, in addition, the "1 location" is selected with the display color of the "1 location" in the bound location setting portion 311 changed. At this time, further, the "2 locations" in the bound location setting portion 311 is not selectable by the user.

Thus, the "2 locations" in the bound location setting portion 311 and the "2 locations" in the hole forming location setting portion 312 may not be selected at the same time in the normal mode setting screen 310.

In the case where the "2 locations" in the bound location setting portion 311 and the "2 locations" in the hole forming location setting portion 312 are selected at the same time, binding process conditions and hole forming process conditions for performing the overlapping post-processing are to be set. Therefore, the overlapping post-processing is not executed in the normal mode by suppressing occurrence of a situation in which the "2 locations" is selected in the bound location setting portion 311 and the "2 locations" is selected in the hole forming location setting portion 312 at the same time on the normal mode setting screen 310.

Figure 8A:
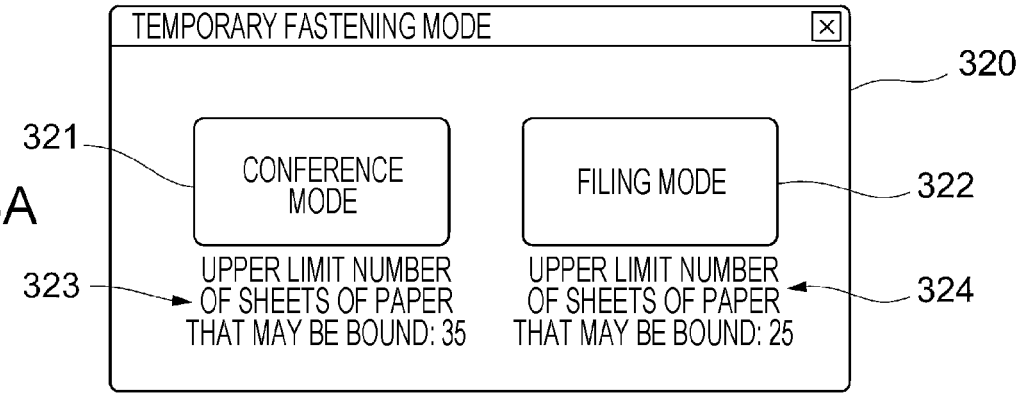
FIG. 8A illustrates a temporary fastening mode setting screen.

When the user selects the temporary fastening mode select portion 302, for example, in the case where the normal mode setting screen 300 in FIG. 7A is displayed on the UI 30, a temporary fastening mode setting screen 320 is displayed as illustrated in FIG. 8A. The temporary fastening mode setting screen 320 is used to set detailed modes of the temporary fastening mode.

The detailed modes of the temporary fastening mode include a conference mode and a filing mode.

The conference mode, which is an example of a fourth mode, is used for the purpose of temporarily binding the paper bundle B and thereafter removing a sheet of the paper P from the bound paper bundle B. For example, in the case where it is intended to carry the paper bundle B in a bound state and thereafter remove sheets of the paper P from the paper bundle B to distribute such sheets in a conference or the like, the overlapping post-processing of the paper bundle B is performed in the conference mode.

In the filing mode, which is an example of a third mode, the overlapping post-processing is performed such that a sheet of the paper P is not easily separable from the paper bundle B compared to the conference mode. The filing mode is used for the purpose of keeping the paper bundle B bound at least until being filed, etc., in the case where the bound paper bundle B is to be filed, for example.

The temporary fastening mode setting screen 320 displays a conference mode select portion 321 that is used to select the conference mode, and a filing mode select portion 322 that is used to select the filing mode. The temporary fastening mode setting screen 320 also displays a conference binding sheet number indication portion 323 and a filing binding sheet number indication portion 324.

The conference binding sheet number indication portion 323 displays the upper limit number of sheets of the paper P that may be bound in the conference mode, which is larger than the upper limit number of sheets of the paper P that may be bound in the normal mode. In the illustrated example, the conference binding sheet number indication portion 323 indicates that the upper limit number of sheets of the paper P that may be bound in the conference mode is "35 sheets".

The filing binding sheet number indication portion 324 displays the upper limit number of sheets of the paper P that may be bound in the filing mode, which is larger than the upper limit number of sheets of the paper P that may be bound in the normal mode. In the illustrated example, the filing binding sheet number indication portion 324 indicates that the upper limit number of sheets of the paper P that may be bound in the filing mode is "25 sheets". That is, the upper limit number of sheets of the paper P that may be bound in the filing mode is smaller than the upper limit number of sheets of the paper P that may be bound in the conference mode.

Thus, in the present exemplary embodiment, the upper limit number of sheets of the paper P that may be bound in the temporary fastening mode is larger than that in the normal mode.

In the normal mode, as discussed above, the upper limit number of sheets of the paper P that may be bound is set as the upper limit number of sheets of the paper P for which separation of a sheet of the paper P from the paper bundle B is suppressed in the case where it is not intended that the user removes a sheet of the paper P from the paper bundle B.

In the case where the binding process is performed on the paper bundle B in the temporary fastening mode, in contrast, it is assumed that a sheet of the paper P is removed from the bound paper bundle B. Therefore, conditions required against separation of a sheet of the paper P from the paper bundle B in the temporary fastening mode are loose compared to the normal mode. Thus, the upper limit number of sheets of the paper P that may be bound is increased in the temporary fastening mode, compared to the normal mode, to increase the number of sheets of the paper P that constitute the paper bundle B to be bound at least temporarily.

Figure 8B:
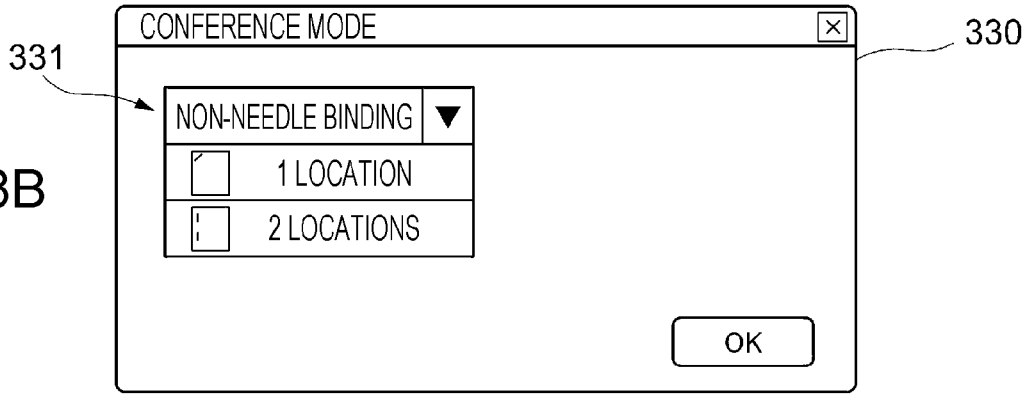
FIG. 8B illustrates a conference mode setting screen.

When the user selects the conference mode select portion 321, for example, a conference mode setting screen 330 is displayed on the UI 30 as illustrated in FIG. 8B. The conference mode setting screen 330 is used to set the content of the binding process in the conference mode.

The temporary fastening mode setting screen 330 displays a bound location setting portion 331 that is used to set the locations of the paper bundle B at which the binding process is to be performed. In the bound location setting portion 331, either of "1 location" and "2 locations" is selectable as the number of locations of the paper bundle B at which the binding process is to be performed. The "1 location" indicated in the bound location setting portion 331 corresponds to the (3*c*) region in FIG. 3. The "2 locations" indicated in the bound location setting portion 331 correspond to the (3*a*) region and the (3*b*) region in FIG. 3.

In the conference mode, the user may not be able to set the content of the hole forming process. In the post-processing in the conference mode, the hole forming process is performed in a region including a part of the binding region which is set using the bound location setting portion 331. It should be noted, however, that the user may be able to set the content of the hole forming process also in the conference mode.

Figure 8C:
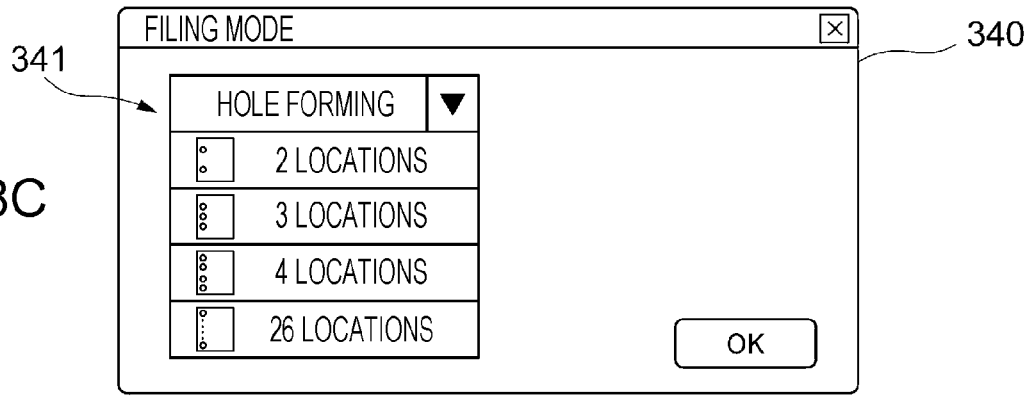
FIG. 8C illustrates a filing mode setting screen.

When the user selects the filing mode select portion 322, for example, in the case where the temporary fastening mode setting screen 320 illustrated in FIG. 8A is displayed, a filing mode setting screen 340 is displayed as illustrated in FIG. 8C. The filing mode setting screen 340 is used to set the content of the overlapping post-processing in the filing mode.

The filing mode setting screen 340 displays a hole forming location setting portion 341 that is used to set the locations of the paper bundle B at which a hole is to be formed by the hole forming process. In the hole forming location setting portion 341, any of "2 locations", "3 locations", "4 locations", and "26 locations" are selectable as the number of locations of the paper bundle B at which a hole is to be formed by the hole forming process. The specific locations of the paper bundle B at which a hole is to be formed will be discussed later.

In the filing mode, the user may not be able to set the content of the binding process. In the filing mode, the content of the binding process is determined in accordance with the number of sheets of the paper P that constitute the paper bundle B to be subjected to the binding process and the content which is set using the hole forming location setting portion 341.

[Content of Binding Process in Filing Mode]

Next, the content of the binding process in the filing mode will be described. FIGS. 9A and 9B to 11 each illustrate locations of the paper bundle B at which the binding process is performed in the filing mode.

First, the locations of the paper bundle B at which the binding process is to be performed in the case where the "2 locations" are set in the hole forming location setting portion 341 illustrated in FIG. 8C will be described.

Figure 9B:
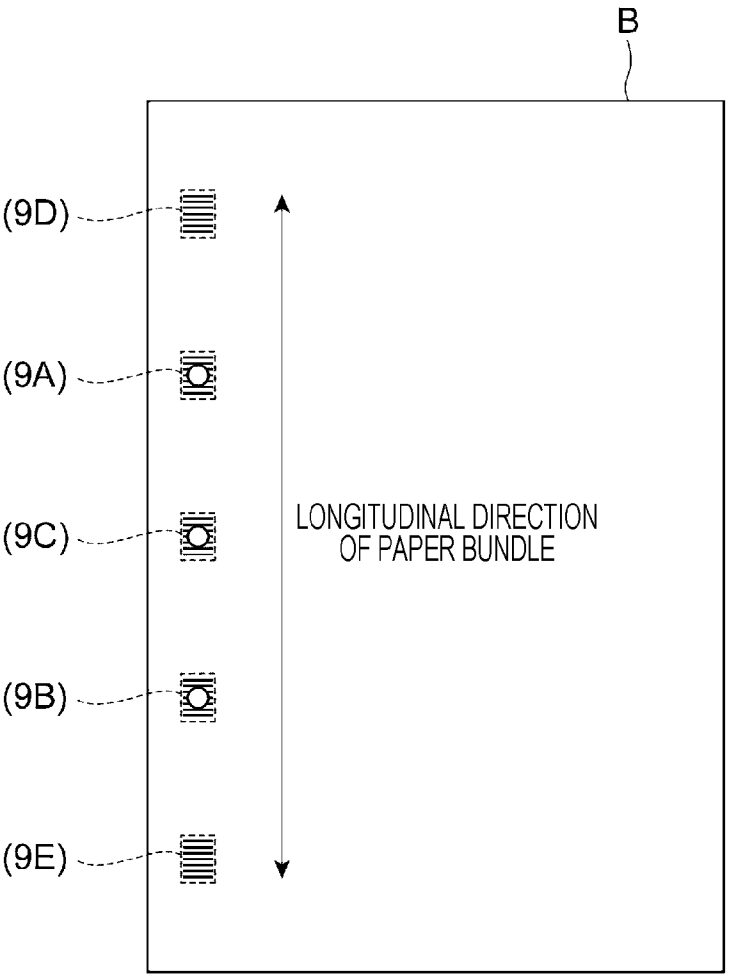
FIGS. 9A and 9B illustrate locations of a paper bundle at which a binding process is performed in a filing mode.
Figure 9A:
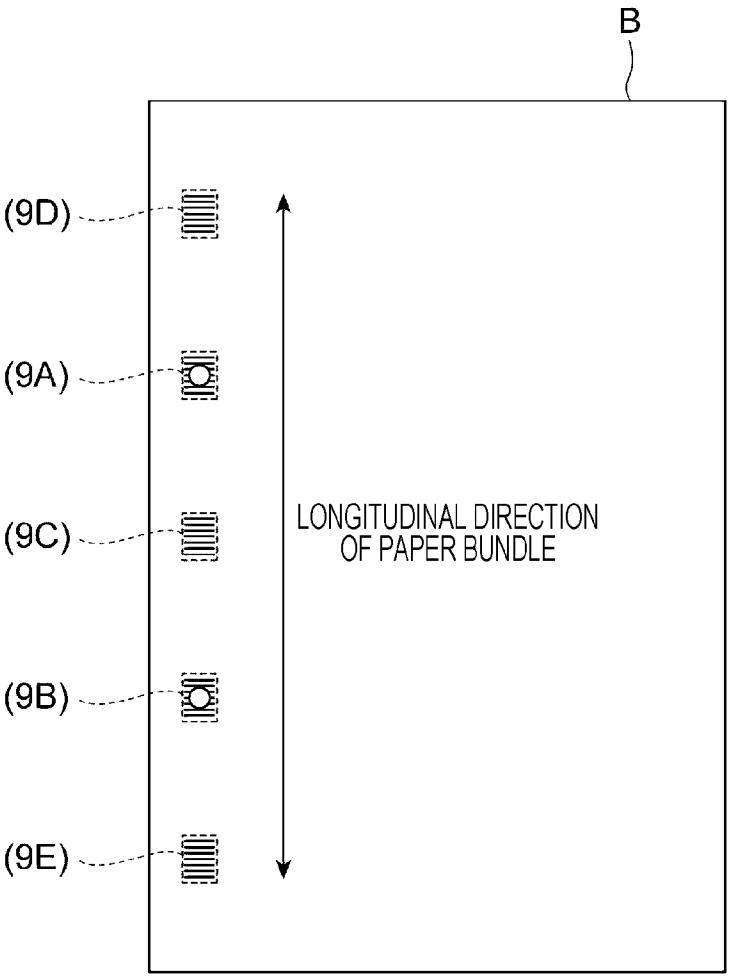

In the case where the number of sheets of the paper P that constitute the paper bundle B to be subjected to the binding process is 10 sheets or less, the binding process is performed in a (9A) region and a (9B) region in the longitudinal direction of the paper bundle B as illustrated in FIG. 9A.

In the case where the number of sheets of the paper P that constitute the paper bundle B to be subjected to the binding process is more than 10 sheets and 20 sheets or less, the binding process is performed in a (9C) region between the (9A) region and the (9B) region, in addition to the (9A) region and the (9B) region.

In the case where the number of sheets of the paper P that constitute the paper bundle B to be subjected to the binding process is more than 20 sheets, the binding process is performed in a (9D) region and a (9E) region on the outer sides of the (9A) region and the (9B) region in the longitudinal direction of the paper bundle B, in addition to the (9A) region, the (9B) region, and the (9C) region.

In addition, a hole is formed by the hole forming process at two locations, in a region including a part of the (9A) region and a region including a part of the (9B) region, regardless of the number of sheets of the paper P which constitute the paper bundle B to be subjected to the binding process.

Next, the locations of the paper bundle B at which the binding process is to be performed in the case where the "3 locations" are set in the hole forming location setting portion 341 illustrated in FIG. 8C will be described.

In the case where the number of sheets of the paper P that constitute the paper bundle B to be subjected to the binding process is 10 sheets or less, the binding process is performed in the (9A) region and the (9B) region in the longitudinal direction of the paper bundle B as illustrated in FIG. 9B.

In the case where the number of sheets of the paper P that constitute the paper bundle B to be subjected to the binding process is more than 10 sheets and 20 sheets or less, the binding process is performed in the (9C) region between the (9A) region and the (9B) region, in addition to the (9A) region and the (9B) region.

In the case where the number of sheets of the paper P that constitute the paper bundle B to be subjected to the binding process is more than 20 sheets, the binding process is performed in the (9D) region and the (9E) region on the outer sides of the (9A) region and the (9B) region in the longitudinal direction of the paper bundle B, in addition to the (9A) region, the (9B) region, and the (9C) region.

In addition, a hole is formed by the hole forming process at three locations, in a region including a part of the (9A) region, a region including a part of the (9B) region, and a region including a part of the (9C) region, regardless of the number of sheets of the paper P which constitute the paper bundle B to be subjected to the binding process.

Next, the locations of the paper bundle B at which the binding process is to be performed in the case where the "4 locations" are set in the hole forming location setting portion 341 illustrated in FIG. 8C will be described.

Figure 10:
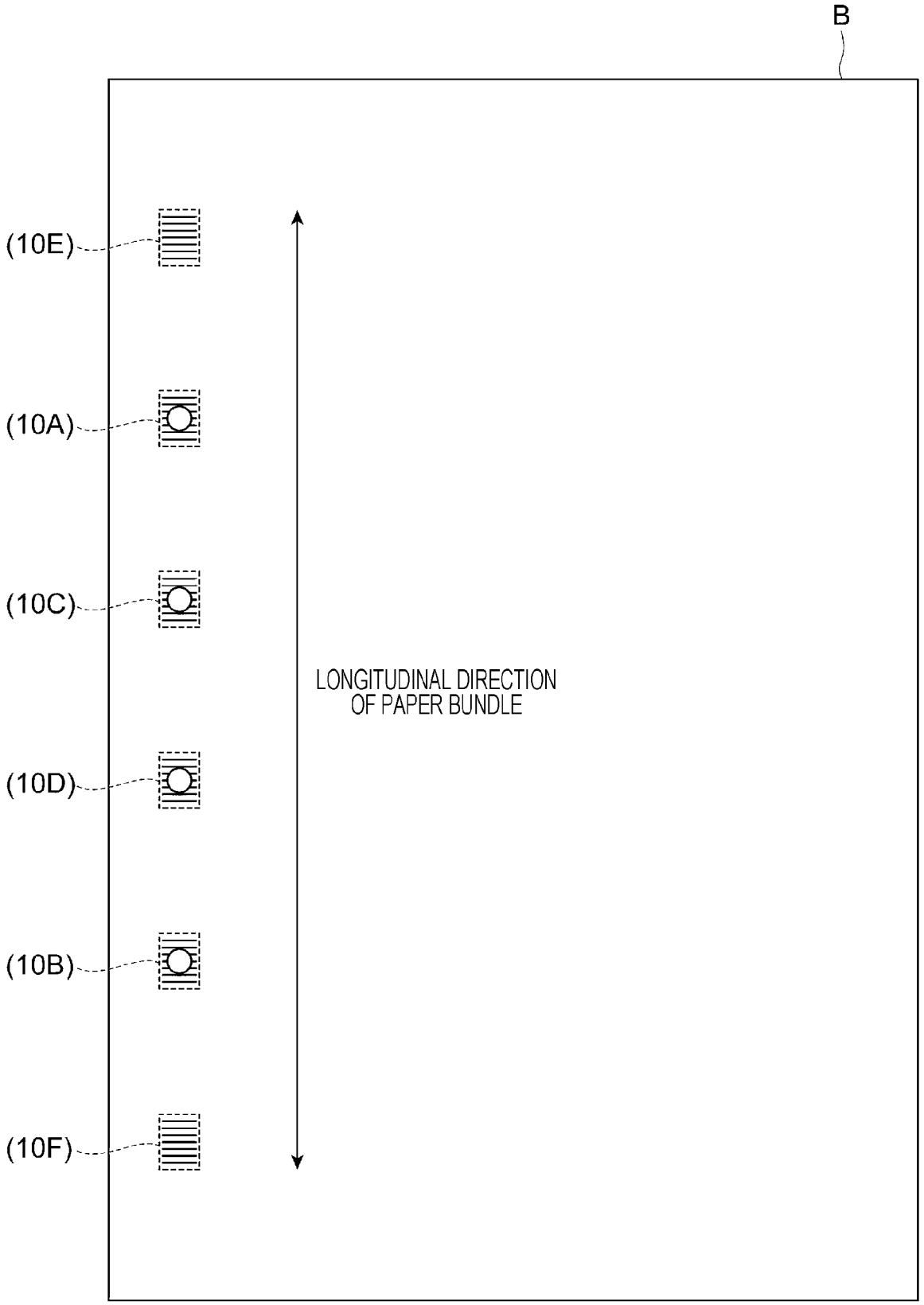
FIG. 10 illustrates locations of a paper bundle at which a binding process is performed in the filing mode.

In the case where the number of sheets of the paper P that constitute the paper bundle B to be subjected to the binding process is 10 sheets or less, the binding process is performed in a (10A) region and a (10B) region in the longitudinal direction of the paper bundle B as illustrated in FIG. 10.

In the case where the number of sheets of the paper P that constitute the paper bundle B to be subjected to the binding process is more than 10 sheets and 20 sheets or less, the binding process is performed in a (10C) region and a (10C) region between the (10A) region and the (10B) region in the longitudinal direction of the paper bundle B, in addition to the (10A) region and the (10B) region.

In the case where the number of sheets of the paper P that constitute the paper bundle B to be subjected to the binding process is more than 20 sheets, the binding process is performed in a (10E) region and a (10F) region on the outer sides of the (10A) region and the (10B) region in the longitudinal direction of the paper bundle B, in addition to the (10A) region, the (10B) region, the (10C) region, and the (10D) region.

In addition, a hole is formed by the hole forming process at four locations, in a region including a part of the (10A) region, a region including a part of the (10B) region, a region including a part of the (10C) region, and a region including a part of the (10D) region, regardless of the number of sheets of the paper P which constitute the paper bundle B to be subjected to the binding process.

Next, the locations of the paper bundle B at which the binding process is to be performed in the case where the "26 locations" are set in the hole forming location setting portion 341 illustrated in FIG. 8C will be described.

Figure 11:
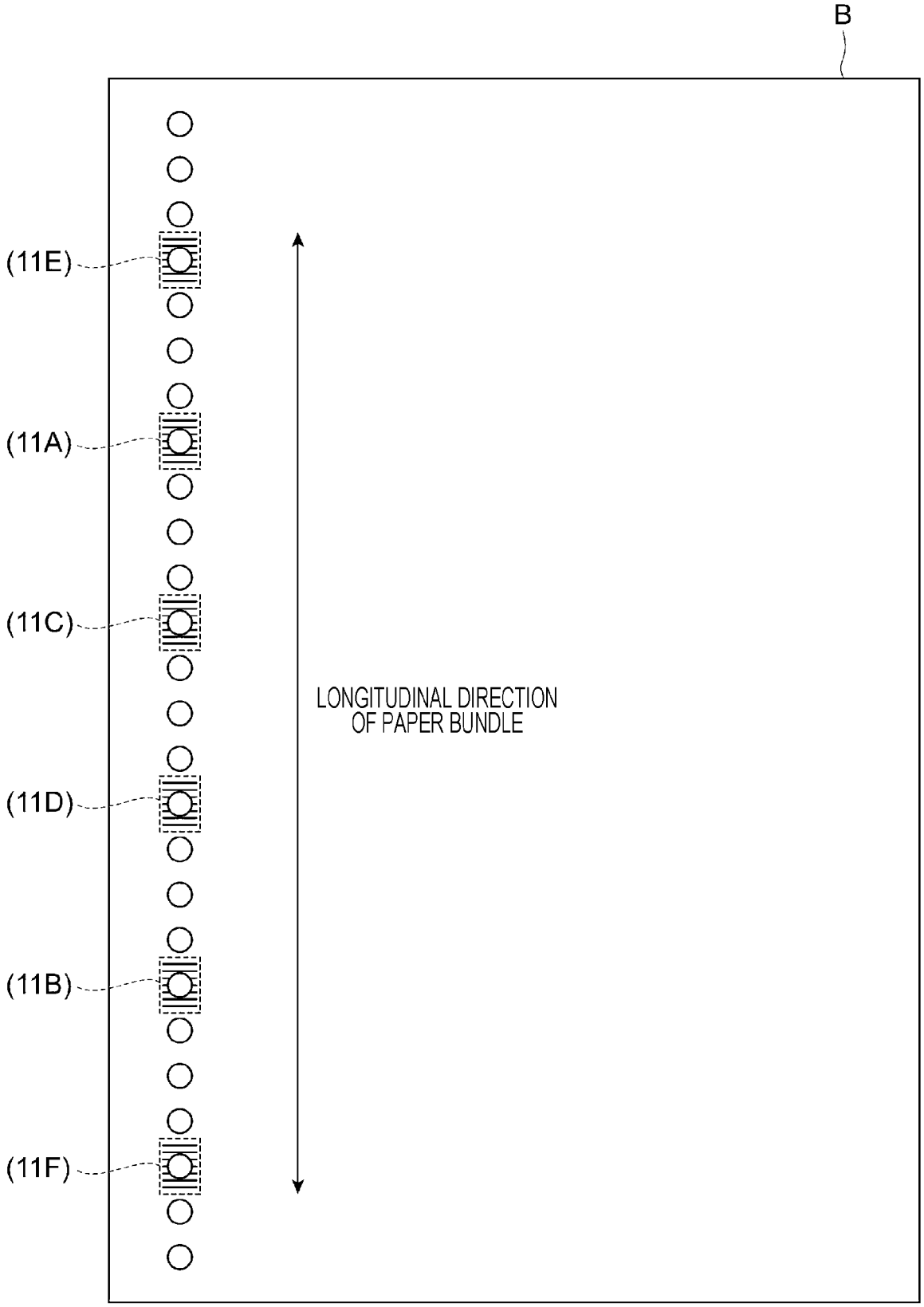
FIG. 11 illustrates locations of a paper bundle at which a binding process is performed in the filing mode.

In the case where the number of sheets of the paper P that constitute the paper bundle B to be subjected to the binding process is 10 sheets or less, the binding process is performed in a (11A) region and a (11B) region in the longitudinal direction of the paper bundle B as illustrated in FIG. 11.

In the case where the number of sheets of the paper P that constitute the paper bundle B to be subjected to the binding process is more than 10 sheets and 20 sheets or less, the binding process is performed in a (11C) region and a (11C) region between the (11A) region and the (11B) region in the longitudinal direction of the paper bundle B, in addition to the (11A) region and the (11B) region.

In the case where the number of sheets of the paper P that constitute the paper bundle B to be subjected to the binding process is more than 20 sheets, the binding process is performed in a (11E) region and a (11F) region on the outer sides of the (11A) region and the (11B) region in the longitudinal direction of the paper bundle B, in addition to the (11A) region, the (11B) region, the (11C) region, and the (11D) region.

In addition, a hole is formed at 26 locations in the longitudinal direction of the paper bundle B, regardless of the number of sheets of the paper P which constitute the paper bundle B to be subjected to the binding process. The holes to be formed at the 26 locations include a hole to be formed in each of a region including a part of the (11A) region, a region including a part of the (11B) region, a region including a part of the (11C) region, a region including a part of the (11D) region, a region including a part of the (11E) region, and a region including a part of the (11F) region.

FIG. 12 illustrates the relationship among the number of sheets of the paper P that constitute the paper bundle B to be subjected to the binding process, the number of locations of the paper bundle B at which a hole is to be formed, and locations of the paper bundle B at which the binding process is to be performed in the filing mode. The "number of sheets to be bound" indicates the number "N" of sheets of the paper P that constitute the paper bundle B to be subjected to the binding process. In addition, the "number of holes" indicates the number of locations of the paper bundle B at which a hole is to be formed. Further, the locations of the paper bundle B at which the binding process is to be performed are indicated in association with the "number of sheets to be bound" and the "number of holes". The regions indicated as the "locations of the paper bundle B at which the binding process is to be performed" correspond to the regions of the paper bundle B illustrated in FIGS. 9A and 9B to 11.

In the present exemplary embodiment, in the filing mode, if the number of sheets of the paper P that constitute the paper bundle B to be subjected to the binding process is larger, the number of locations at which the binding process is to be performed is increased. Specifically, in the filing mode, in the case where the number of sheets of the paper P that constitute the paper bundle B to be subjected to the binding process is 11 sheets or more, the number of locations at which the binding process is to be performed is increased. In the filing mode, in addition, in the case where the number of sheets of the paper P that constitute the paper bundle B to be subjected to the binding process is 21 sheets or more, the number of locations at which the binding process is to be performed is further increased. The "11 sheets" and the "21 sheets" are considered as a prescribed third number of sheets.

In the conference mode, the number of locations at which the binding process is to be performed is not changed, depending on the number of sheets of the paper P that constitute the paper bundle B to be subjected to the binding process. In contrast, in the filing mode, as discussed above, the overlapping post-processing is performed such that a sheet of the paper P is not easily separable from the paper bundle B compared to the conference mode. Therefore, in the filing mode, the number of locations at which the binding process is to be performed is increased as the number of sheets of the paper P that constitute the paper bundle B to be subjected to the binding process is larger.

In addition, in the present exemplary embodiment, the non-needle-binding unit 50 performs the binding process at a plurality of locations of the paper bundle B in the longitudinal direction in the filing mode. Then, in the case where the number of sheets of the paper P that constitute the paper bundle B to be subjected to the binding process is less than 11 sheets, the hole forming unit 80 performs a hole forming process in a region including a part of the binding regions at locations on both outer sides in the longitudinal direction of the paper bundle B, among the plurality of locations at which the binding process has been performed. That is, a hole forming process is performed in a region including a part of the binding region at locations, among the plurality of locations at which the binding process has been performed, to which an external force tends to be applied compared to locations on the inner sides in the longitudinal direction of the paper bundle B.

In the filing mode, the binding process is not performed at a corner portion of the paper bundle B indicated by the (3*c*) region in FIG. 3. That is, in the filing mode, the binding process on the paper bundle B in a region that is different from regions in the transport direction (see FIG. 3) of the paper bundle B, including a plurality of regions in which the hole forming process is to be performed, is restricted. Therefore, the filing mode setting screen 340 (see FIG. 8C) does not display a screen that enables setting to perform the binding process at a corner portion of the paper bundle B.

[Operation Control for Non-Needle-Binding Unit and Hole Forming Unit]

Next, operation control for the non-needle-binding unit 50 and the hole forming unit 80 performed by the paper processing control portion 23 will be described.

Figure 13:
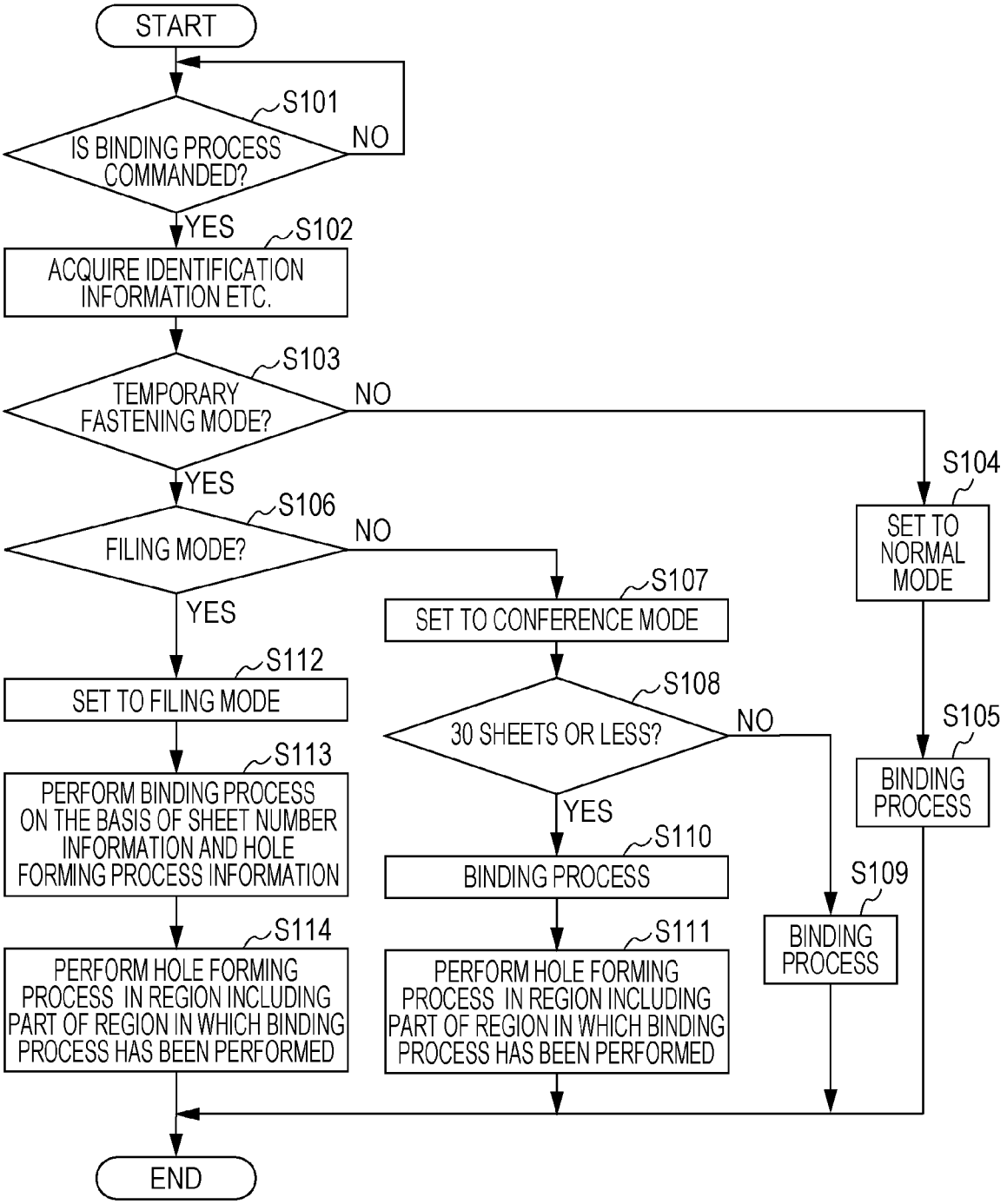
FIG. 13 is a flowchart illustrating an example of operation control performed by the paper processing control portion.

FIG. 13 is a flowchart illustrating an example of operation control performed by the paper processing control portion 23.

First, the paper processing control portion 23 determines whether or not the non-needle-binding unit 50 commands a binding process (S101). This determination is made in accordance with whether or not a command for a binding process is transmitted from the body control portion 106 of the image forming apparatus 1 to the paper processing control portion 23. The paper processing control portion 23 repeatedly makes the determination in step S101 while a negative result is continued.

In the case where the body control portion 106 transmits a command for a binding process to the paper processing control portion 23, on the other hand, an affirmative result is obtained, and the process proceeds to step S102.

The paper processing control portion 23 acquires identification information that enables identification of the control mode for the paper processing control portion 23 from the body control portion 106. The paper processing control portion 23 also acquires sheet number information on the number of sheets of the paper P that constitute the paper bundle B to be subjected to the binding process, binding process information on the locations of the paper bundle B at which the binding process is to be performed, and hole forming process information on the locations of the paper bundle B at which a hole is to be formed (S102).

The paper processing control portion 23 determines whether or not the control mode which is specified from the identification information is the temporary fastening mode (S103). In the case where a negative result is obtained, the control mode for the paper processing control portion 23 is set to the normal mode (S104). The paper processing control portion 23 performs a binding process on the paper bundle B on the basis of the binding process information (S105). In the case where the hole forming process information has been acquired, in addition, the paper processing control portion 23 performs a hole forming process on the paper bundle B on the basis of the hole forming process information. In this case, a hole forming process is performed in a region of the paper bundle B not including a region in which the binding process has been performed.

In the case where an affirmative result is obtained in step S103, the paper processing control portion 23 determines whether or not the control mode is the filing mode (S106). In the case where a negative result is obtained, the control mode for the paper processing control portion 23 is set to the conference mode (S107).

The paper processing control portion 23 determines whether or not the number of sheets of the paper P that constitute the paper bundle B to be subjected to the binding process is 30 sheets or less (S108). In the case where a negative result is obtained, the paper processing control portion 23 performs a binding process on the paper bundle B on the basis of the binding process information (S109). In addition, the paper processing control portion 23 does not perform a hole forming process on the paper bundle B which has been subjected to the binding process.

Thus, in the present exemplary embodiment, in the conference mode, in the case where the non-needle-binding unit 50 performs a binding process on the paper bundle B which is constituted from 31 sheets or more of the paper P, a hole forming process is not performed on the paper bundle B which has been subjected to the binding process. The "31 sheets" is considered as a prescribed first number of sheets.

In the case where an affirmative result is obtained in step S108, on the other hand, the paper processing control portion 23 performs a binding process on the paper bundle B on the basis of the binding process information (S110). In addition, the paper processing control portion 23 performs a hole forming process in a region of the paper bundle B including a part of a region in which the binding process has been performed on the basis of the hole forming process information (S111).

In the case where an affirmative result is obtained in step S106, meanwhile, the control mode for the paper processing control portion 23 is set to the filing mode (S112). In this case, the paper processing control portion 23 performs a binding process on the paper bundle B on the basis of the sheet number information and the hole forming process information (S113). In addition, the paper processing control portion 23 performs a hole forming process in a region of the paper bundle B including a part of a region in which the binding process has been performed (S114).

In the present exemplary embodiment, in the conference mode, a hole forming process is not performed in the case where the paper bundle B to be subjected to the binding process is constituted from 31 sheets or more of the paper P. However, the present disclosure is not limited thereto.

For example, in the conference mode, a hole forming process may be performed in a region of the paper bundle B not including a region in which the binding process is performed in the case where the number of sheets of the paper P that constitute the paper bundle B to be subjected to the binding process is 31 sheets or more. That is, the region of the paper bundle B in which a hole forming process is to be performed may be changed so that overlapping post-processing is not performed. Alternatively, the region of the paper bundle B in which a binding process is to be performed may be changed, without changing the region of the paper bundle B in which a hole forming process is to be performed, for example, so that overlapping post-processing is not performed.

In addition, in the present exemplary embodiment, in the case where the binding process by the non-needle-binding unit 50 and the hole forming process by the hole forming unit 80 are performed on the paper bundle B, the binding process is first performed on the paper bundle B, and the hole forming process is performed on the paper bundle B which has been bound. However, the present disclosure is not limited thereto.

For example, the hole forming process may be performed on the paper bundle B, and the binding process may be performed on the paper bundle B in which holes have been formed.

[Modification]

Subsequently, a modification of the overlapping post-processing will be described.

The overlapping post-processing by the post-processing device 2 is not limited to that described above.

Figure 14:
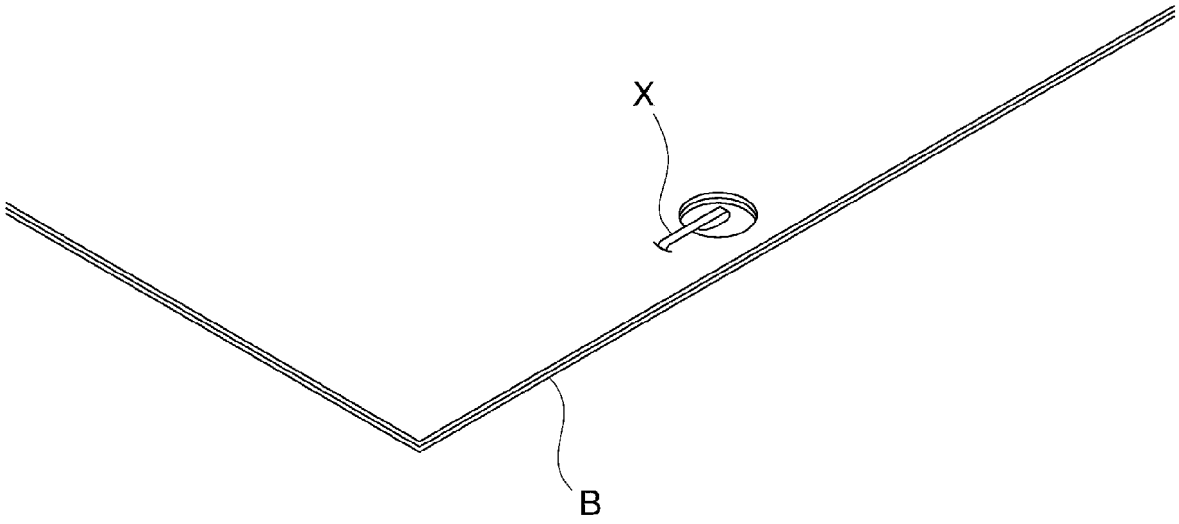
FIG. 14 illustrates a paper bundle on which overlapping post-processing has been performed according to a modification.

FIG. 14 illustrates the paper bundle B on which overlapping post-processing has been performed according to a modification.

In the modification, first, a hole forming process is performed on the paper bundle B by the hole forming unit 80. Then, a binding process by the needle-binding unit 70 is performed in a region of the paper bundle B including a part of a region in which a hole has been formed. Specifically, a binding process is performed such that one end of a staple X sticks into the paper bundle B while the other end of the staple X passes through a hole formed by the hole forming process without sticking into the paper bundle B.

Second Exemplary Embodiment

Figure 15:
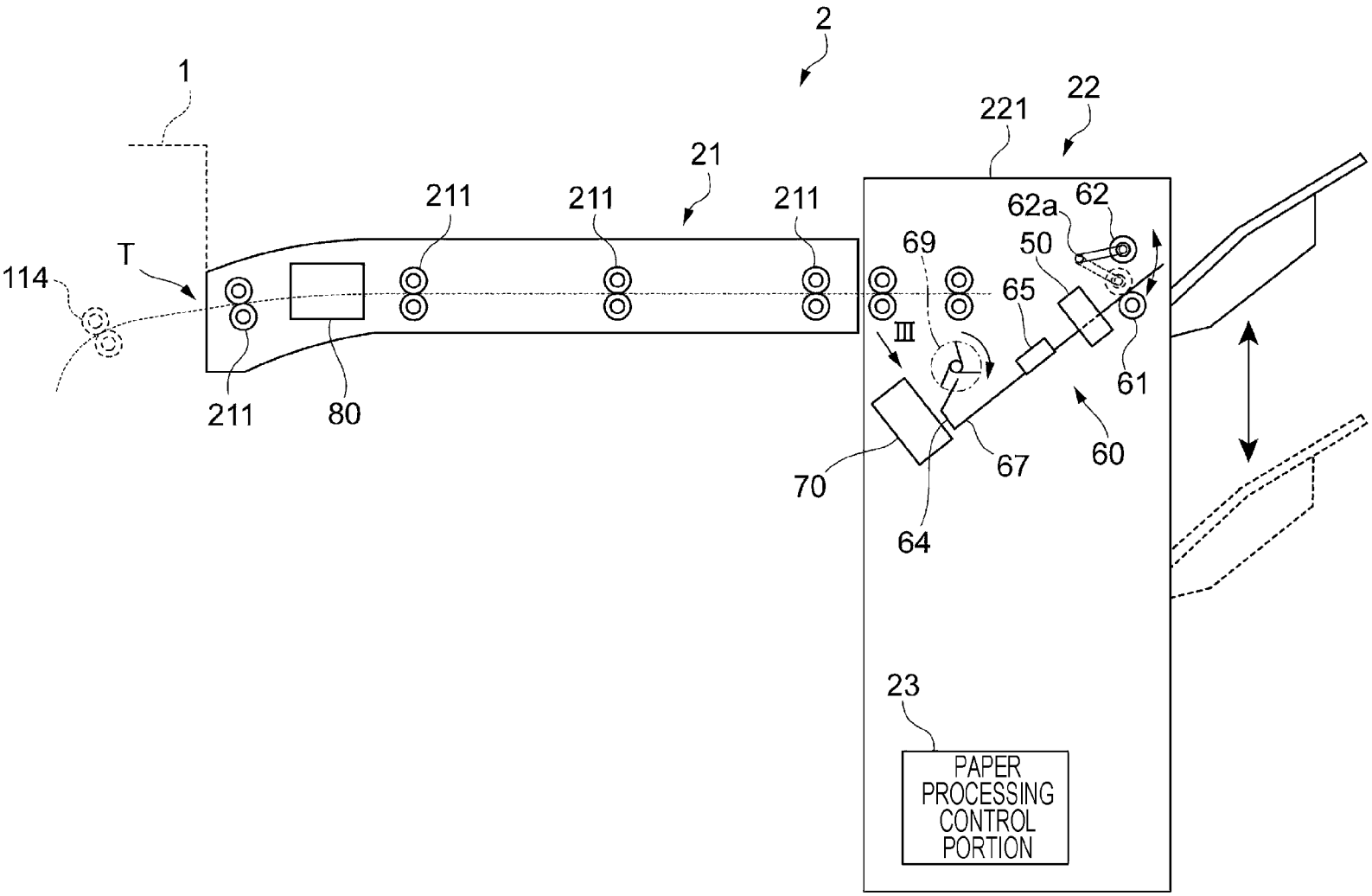
FIG. 15 illustrates the configuration of a post-processing device according to a second exemplary embodiment.

FIG. 15 illustrates the configuration of the post-processing device 2 according to a second exemplary embodiment. Components that are similar to those according to the first exemplary embodiment are denoted by the same reference numerals.

Also in this configuration example, as illustrated in FIG. 15, the finisher unit 22 includes the non-needle-binding unit 50 and the needle-binding unit 70.

In addition, the transport unit 21 includes the hole forming unit 80.

The hole forming unit 80 is provided in the finisher unit 22 in the exemplary embodiment described above (configuration illustrated in FIG. 2). However, the arrangement of the hole forming unit 80 is not limited thereto, and the hole forming unit 80 may be disposed as illustrated in FIG. 15.

In the configuration illustrated in FIG. 15, when the paper P is transported from the image forming apparatus 1 into the transport unit 21 of the post-processing device 2, a hole forming process by the hole forming unit 80 is performed on the paper P which has been transported. The paper P which has been subjected to the hole forming process is fed to the finisher unit 22 by the transport rollers 211, and transported to the paper stacking portion 60. After that, each time a sheet of the paper P is transported into the transport unit 21, the sheet of the paper P is subjected to the hole forming process and transported to the paper stacking portion 60 to generate a paper bundle B constituted from a plurality of sheets of the paper P, in which holes have been formed, on the paper stacking portion 60.

Subsequently, the non-needle-binding unit 50 performs a binding process on the generated paper bundle B. In this case, in the case where the control mode is set to the temporary fastening mode, the binding process is performed in a region of the paper bundle B including a region in which a hole is formed.

Also in this case, the binding force for the paper bundle B at a portion of the paper bundle B at which the binding process has been performed is reduced by an amount corresponding to a reduction in the region of the paper bundle B in which sheets of the paper P are pressure-bonded to each other by the binding process, compared to a case where the region of the paper bundle B in which the binding process has been performed and the region in which a hole has been formed do not overlap each other. That is, the configuration in which "the binding process is performed on the paper bundle B, and the hole forming process is performed in a hole forming region including a part of a binding region in which the binding process is performed on sheets of the paper P that constitute the paper bundle B" includes a configuration (configuration according to the first exemplary embodiment) in which "the binding process is first performed on the paper bundle B, and next the hole forming process is performed in a region including a part of a region in which the binding process has been performed on sheets of the paper P that constitute the paper bundle B", and a configuration (configuration according to the second exemplary embodiment) in which "the hole forming process is first performed on the paper bundle B, and next the binding process is performed in a region including a region in which the hole forming process has been performed on sheets of the paper P that constitute the paper bundle B".

In the present exemplary embodiment, a hole forming process is performed in a region including a part of a binding region of sheets of the paper P that constitute the paper bundle B. However, a hole forming process is not necessarily performed in a region including a part of a binding region of all the sheets of the paper P that constitute the paper bundle B.

For example, a hole forming process by the hole forming unit 80 may be performed in a region including a part of a binding region of a sheet of the paper P that constitutes the first page of the paper bundle B, and a hole forming process may not be performed on sheets of the paper P that constitute the second and subsequent pages of the paper bundle B. Then, a binding process may be performed on the paper bundle B which is generated on the paper stacking portion 60 in a region including a region in which the hole forming process has been performed on the sheet of the paper P which constitutes the first page. That is, it is only necessary that a hole forming process should be performed in at least a region including a part of a binding region of a sheet of the paper P that constitutes the first page of the paper bundle B. Also in this case, the binding force for the paper bundle B at a portion of the first page, which constitutes the paper bundle B, at which the binding process has been performed is reduced by an amount corresponding to a reduction in the region of the first page in which sheets of the paper P are pressure-bonded to each other by the binding process, compared to a case where the binding region and the hole forming region do not overlap each other.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A recording medium post-processing device comprising:

a binder that performs a binding process on a binding region of a recording medium bundle by compressing a recording medium bundle together without using any staple; and a hole puncher that performs a hole forming process to form a hole in the binding region in which the binding process was performed.

2. The recording medium post-processing device according to claim 1, further comprising:

a processor configured to:

perform a binding control such that the binder performs the binding process in the binding region; and perform a hole forming control such that the hole puncher performs the hole forming process in a region including a part of the binding region, wherein the recording medium post-processing device performs a post-processing for the recording medium bundle in one of a first mode, in which at least one of the binding control by the processor and the hole forming control by the processor is not performed, and a second mode, in which both the binding control and the hole forming control are performed.

3. The recording medium post-processing device according to claim 2, wherein both the binding control and the hole forming control are performed in the second mode and the binding process is performed on the recording medium bundle which is equals to a prescribed first number of recording media or more.

4. The recording medium post-processing device according to claim 2, wherein an upper limit number of recording media that can be bound by the binding process is larger in the second mode than in the first mode.

5. The recording medium post-processing device according to claim 1, wherein the recording medium post-processing device performs the binding process in the binding region of the recording media and the hole forming process in a region including a part of the binding region in one of a third mode, in which an upper limit number of recording media that may be bound is a prescribed second number which is larger than the prescribed first number, and a fourth mode, in which the upper limit number is more than the second number, and the binder performs the binding process at an increased number of locations in a case where a number of recording media that constitute the recording medium bundle to be subjected to the binding process is a prescribed third number or more in the third mode, compared to a case where the number of such recording media is less than the third number.

6. The recording medium post-processing device according to claim 5, wherein the binder performs the binding process at a plurality of locations in one direction of the recording medium bundle in the third mode, and the hole puncher performs the hole forming process in a region including a part of the binding regions at locations on outer sides of the part of the binding regions in the one direction, among the plurality of locations, in a case where a number of recording media that constitute the recording medium bundle to be subjected to the hole forming process is less than the third number.

7. The recording medium post-processing device according to claim 5, wherein the hole binder performs the hole forming process in at least another region in one direction in the third mode, and the binding process on the recording medium bundle in a corner region that is different from regions in the one direction is restricted in the third mode.

8. The recording medium post-processing device according to claim 1, further comprising:

a conveyor belt that transports the recording media;

a supporting plate on which the recording media which are transported by the transport unit are stacked; and an alignment member that comprises a surface which aligns the recording media by clamping the recording media at one end portion and the other end portion thereof each time a recording medium arrives at the stacking unit, wherein the binder performs the binding process in the binding region of the recording medium bundle, the recording media of which have been aligned by the alignment unit, and the hole puncher performs the hole forming process in a region including a part of the binding region of the recording medium bundle which has been subjected to the binding process.

9. The recording medium post-processing device according to claim 1, wherein the hole protrudes outside of the binding region.

10. The recording medium post-processing device according to claim 9 wherein the recording medium post-processing device switch among one of four modes as the recording medium post-processing device is configured to perform one of the binding control or the hole forming control in a first mode which has a first upper limit for a quantity of sheets in the recording medium bundle, perform both the binding control and the hole forming control in a second mode which has a second upper limit that is larger than the first upper limit for the quantity of sheets in the recording medium bundle, perform both the binding control and the hole forming control in a third mode which has a third upper limit that is larger than the second upper limit for the quantity of sheets in the recording medium bundle.

11. The recording medium post-processing device according to claim 10 wherein there are more bindings created in the binding control and more holes created in the hole forming control in the third mode than in the second mode.

12. The recording medium post-processing device according to claim 11 wherein the recording medium post-processing device is further configured to perform the binding control in a fourth mode which has an upper larger than the third upper limit for the quantity of sheets in the recording medium bundle.

13. A recording medium post-processing device comprising:

a binder that performs a non-needling binding process on a binding region of a recording medium bundle by applying a pressure to the recording medium bundle in a thickness direction of the recording medium bundle by compressing record medium bundle together without using any staple; and a hole puncher that performs a hole forming process to form a hole the binding region in which the binding process was performed.

14. A recording medium post-processing device comprising:

a binding means for performing a non-needling binding process on a binding region of a recording medium bundle by compressing recording medium bundle together without using any staple; and a hole forming means for performing a hole forming process to form a hole in the binding region in which the binding process was performed.

* * * * *